US011085612B2

(12) United States Patent
Dong

(10) Patent No.: US 11,085,612 B2
(45) Date of Patent: Aug. 10, 2021

(54) ILLUMINATION DEVICES

(71) Applicant: Haisong Dong, Dongguan (CN)

(72) Inventor: Haisong Dong, Guangdong Providence (CN)

(73) Assignee: Haisong Dong, Guangdong Province (CN)

( * ) Notice: Subject to any disclaimer, the term of this patent is extended or adjusted under 35 U.S.C. 154(b) by 0 days.

(21) Appl. No.: 16/804,718

(22) Filed: Feb. 28, 2020

(65) Prior Publication Data

US 2020/0200364 A1 Jun. 25, 2020

Related U.S. Application Data

(63) Continuation of application No. 16/104,867, filed on Aug. 17, 2018, now Pat. No. 10,578,281, which is a (Continued)

(30) Foreign Application Priority Data

Jul. 30, 2013 (CN) ..... 201320480832.9
Aug. 28, 2013 (CN) ..... 201320547507.X (Continued)

(51) Int. Cl.
*F21V 14/02* (2006.01)
*F21S 6/00* (2006.01)

(Continued)

(52) U.S. Cl.
CPC ..... *F21V 14/02* (2013.01); *F21S 6/001* (2013.01); *F21S 9/02* (2013.01); *F21S 10/046* (2013.01);

(Continued)

(58) Field of Classification Search
CPC ..... F21V 14/02; F21S 6/001; F21S 10/046
See application file for complete search history.

(56) References Cited

U.S. PATENT DOCUMENTS 2,976,450 A 3/1961 Benoliel et al.
3,639,749 A 2/1972 Beckman (Continued)

FOREIGN PATENT DOCUMENTS

AT 508262 B1 12/2010
CA 2779978 C 1/2016

(Continued)

OTHER PUBLICATIONS

PCT/IB2014/063038: (a) International Search Report and Written Opinion dated Apr. 14, 2015, and (b) International Preliminary Report on Patentability dated Feb. 11, 2016, issued in PCT/IB2014/063038. Both the instant application and PCT/IB2014/063038 are directed to illumination devices and have priority claims related to U.S. Appl. No. 62/008,281.

(Continued)

*Primary Examiner* — Anne M Hines
(74) *Attorney, Agent, or Firm* — Harness, Dickey & Pierce, P.L.C.

(57) ABSTRACT

An illumination device (e.g., an electric candle, etc.) generally includes a housing, a light source, and a pendulum supporting the light source. The pendulum is pivotally coupled to the housing and is configured to move the light source relative to the housing. The illumination device also includes a control unit for providing power to the illumination device and for controlling operation of the light source, and at least one wire electrically connecting the light source to the control unit. The at least one wire has a diameter of about 0.5 millimeters or less to avoid impact of the wire to the pivotal movement of the pendulum.

9 Claims, 22 Drawing Sheets

Related U.S. Application Data continuation of application No. 15/436,252, filed on Feb. 17, 2017, now Pat. No. 10,082,274, which is a continuation of application No. 14/328,954, filed on Jul. 11, 2014, now Pat. No. 9,574,748.

(60) Provisional application No. 62/008,281, filed on Jun. 5, 2014.

(30) Foreign Application Priority Data

Nov. 12, 2013 (CN) ..... 201320711701.7
Apr. 4, 2014 (CN) ..... 201420165185.7

(51) Int. Cl.

| | |
|---|---|
| ***F21V 17/04*** | (2006.01) |
| ***F21S 10/04*** | (2006.01) |
| ***F21V 19/00*** | (2006.01) |
| ***F21V 23/00*** | (2015.01) |
| ***F21S 9/02*** | (2006.01) |
| ***F21V 9/08*** | (2018.01) |
| ***F21V 14/08*** | (2006.01) |
| *F21W 121/00* | (2006.01) |
| *F21Y 115/10* | (2016.01) |
| *F21Y 101/00* | (2016.01) |

(52) U.S. Cl.

CPC ..... *F21V 9/08* (2013.01); *F21V 14/08* (2013.01); *F21V 17/04* (2013.01); *F21V 19/0005* (2013.01); *F21V 19/0025* (2013.01); *F21V 23/002* (2013.01); *F21W 2121/00* (2013.01); *F21Y 2101/00* (2013.01); *F21Y 2115/10* (2016.08)

(56) References Cited

U.S. PATENT DOCUMENTS

| | | | |
|---|---|---|---|
| 4,965,707 | A | 10/1990 | Butterfield |
| 6,554,443 | B2 | 4/2003 | Fan |
| 7,159,994 | B2 | 1/2007 | Schnuckle et al. |
| 7,261,455 | B2 | 8/2007 | Schnuckle et al. |
| 7,556,408 | B2 | 7/2009 | Thomson |
| 7,686,471 | B2 | 3/2010 | Reichow |
| 7,837,355 | B2 | 11/2010 | Schnuckle |
| 8,070,319 | B2 | 12/2011 | Schnuckle et al. |
| 8,132,936 | B2 | 3/2012 | Patton et al. |
| 8,342,712 | B2 | 1/2013 | Patton et al. |
| 8,534,869 | B2 | 9/2013 | Patton et al. |
| 8,550,660 | B2 | 10/2013 | Patton et al. |
| 8,628,223 | B2 | 1/2014 | Kwok et al. |
| 8,646,946 | B2 | 2/2014 | Schnuckle et al. |
| 8,696,166 | B2 | 4/2014 | Patton et al. |
| 8,721,118 | B2 | 5/2014 | Patton et al. |
| 8,727,569 | B2 | 5/2014 | Schnuckle et al. |
| 8,777,465 | B2 | 7/2014 | Patton et al. |
| 8,789,986 | B2 | 7/2014 | Li |
| 8,926,137 | B2 | 1/2015 | Li |
| 9,574,748 | B2 | 2/2017 | Dong |
| 9,909,728 | B2 | 3/2018 | Dong |
| 9,915,402 | B2 | 3/2018 | Dong |
| 10,082,274 | B2 | 9/2018 | Dong |
| 10,578,281 | B2 | 3/2020 | Dong |
| 2004/0114351 | A1 | 6/2004 | Stokes et al. |
| 2005/0225984 | A1 | 10/2005 | Theobald |
| 2007/0223216 | A1 | 9/2007 | Jensen et al. |
| 2008/0151571 | A1 | 6/2008 | Chen |
| 2010/0079999 | A1 | 4/2010 | Schnuckle |
| 2010/0188859 | A1 | 7/2010 | Zhao |
| 2011/0127914 | A1 | 6/2011 | Patton et al. |
| 2011/0204828 | A1 | 8/2011 | Moody |
| 2012/0134157 | A1 | 5/2012 | Li |
| 2012/0287612 | A1 | 11/2012 | Hau et al. |
| 2012/0300459 | A1* | 11/2012 | Hau ..... F21K 9/23 362/249.02 |
| 2013/0088879 | A1 | 4/2013 | Chartrand |
| 2013/0286642 | A1 | 10/2013 | Patton |
| 2013/0329406 | A1 | 12/2013 | Lederer |
| 2014/0098536 | A1 | 4/2014 | Thompson |
| 2014/0104812 | A1 | 4/2014 | Patton et al. |
| 2014/0177212 | A1 | 6/2014 | Li |
| 2014/0218903 | A1 | 8/2014 | Sheng |
| 2014/0218929 | A1 | 8/2014 | Schnuckle et al. |
| 2014/0313694 | A1 | 10/2014 | Patton et al. |
| 2016/0146414 | A1 | 5/2016 | Dong |
| 2016/0153630 | A1 | 6/2016 | Dong |

FOREIGN PATENT DOCUMENTS

| | | | |
|---|---|---|---|
| CN | 201047546 | Y | 4/2008 |
| CN | 201724143 | U | 1/2011 |
| CN | 101865413 | B | 8/2012 |
| CN | 202469608 | U | 10/2012 |
| CN | 102853368 | A | 1/2013 |
| CN | 202791780 | U | 3/2013 |
| CN | 2013201808329 | | 7/2013 |
| CN | 201320547507X | | 8/2013 |
| CN | 2013207117017 | | 11/2013 |
| CN | 203375334 | U | 1/2014 |
| CN | 203442498 | U | 2/2014 |
| CN | 203571616 | U | 4/2014 |
| CN | 2014201651857 | | 4/2014 |
| CN | 203642063 | U | 6/2014 |
| CN | 203784814 | U | 8/2014 |
| CN | 204005707 | U | 12/2014 |
| DE | 102007014689 | B4 | 8/2011 |
| DE | 202009018453 | U1 | 9/2011 |
| DE | 212011100014 | U1 | 4/2012 |
| DE | 202012102347 | U1 | 7/2012 |
| DE | 202012104217 | U1 | 11/2012 |
| DE | 202013101955 | U1 | 5/2013 |
| DE | 202014100821 | U1 | 3/2014 |
| EP | 0138786 | B1 | 12/1987 |
| EP | 0826129 | B1 | 11/2003 |
| EP | 1496306 | A3 | 9/2007 |
| EP | 2232128 | B1 | 2/2013 |
| EP | 2454521 | B1 | 5/2013 |
| EP | 2715223 | A4 | 1/2015 |
| EP | 2278211 | B1 | 4/2015 |
| EP | 2587127 | A4 | 4/2015 |
| EP | 2644970 | B1 | 11/2015 |
| EP | 2565518 | B1 | 1/2016 |
| EP | 2546571 | B1 | 10/2016 |
| EP | 2833051 | B1 | 4/2017 |
| FR | 2972520 | A1 | 9/2012 |
| GB | 1164144 | A | 9/1969 |
| GB | 2404730 | A | 2/2005 |
| JP | 3148132 | U | 1/2009 |
| JP | 201289462 | A | 5/2012 |
| WO | WO-82/02756 | A1 | 8/1982 |
| WO | WO-9625624 | A1 | 8/1996 |
| WO | WO-2012/000418 | A1 | 1/2012 |
| WO | WO-2012/162538 | A1 | 11/2012 |
| WO | WO-2013/089401 | A1 | 6/2013 |
| WO | WO-2013/186875 | A1 | 12/2013 |
| WO | WO-2013/189187 | A1 | 12/2013 |
| WO | WO-2015/015346 | A3 | 8/2015 |
| WO | WO-2016/151414 | A1 | 9/2016 |

OTHER PUBLICATIONS

PCT/IB2016/050553: (a) International Search Report and Written Opinion dated Jun. 14, 2016, (b) International Preliminary Report on Patentability dated Oct. 5, 2017 issued in PCT/IB2016/050553. Both the instant application and PCT/IB2014/063038 are directed to illumination devices and have priority claims related to U.S. Appl. No. 62/008,281.

EP 14 179 195.4: (a) Extended European Search Report dated Oct. 14, 2014, (b) Intent to Grant dated Oct. 12, 2016, and (c) Decision to Grant dated Mar. 9, 2017, issued in EP 14 179 195.4. Both the

(56) References Cited

OTHER PUBLICATIONS instant application and EP 14 179 195.4 are directed to illumination devices and have priority claims related to U.S. Appl. No. 62/008,281.
EP 17 164 846.2(a) Extended European Search Report dated Jun. 20, 2017, (b) Examination Report dated Oct. 19, 2018, (c) Examination Report dated May 20, 2019, (d) Summons to Attend Oral Proceedings dated Feb. 4, 2020, (e) Summons to Attend Oral Proceedings dated Jun. 3, 2020, and (f) Result of Consultation dated Jun. 15, 2020, issued in EP 17 164 846.2. Both the instant application and EP 17 164 846.2 are directed to illumination devices and have priority claims related to U.S. Appl. No. 62/008,281.
Extended European Search issued in European Patent Application No. 21165659.0 dated May 4, 2021. Both the instant application and EP 21165659.0 are directed to illumination devices and both have priority claims related to U.S. Prov. Appl. No. 62/008,281. All of the references cited in the Extended European Search Report have previously been submitted to the Office (and considered by the Office) by the way of the Information Disclosure Statement dated Jul. 28, 2020.

* cited by examiner

ILLUMINATION DEVICES

CROSS-REFERENCE TO RELATED APPLICATIONS

This application is a continuation of U.S. application Ser. No. 16/104,867 filed Aug. 17, 2018, which is a continuation of U.S. application Ser. No. 15/436,252 filed Feb. 17, 2017 (U.S. Pat. No. 10,082,274), which is a continuation of U.S. application Ser. No. 14/328,954 filed Jul. 11, 2014 (U.S. Pat. No. 9,574,748), which claims the benefit of, and priority to, Chinese Application No. 201320480832.9 filed Jul. 30, 2013, Chinese Application No. 201320547507.X filed Aug. 28, 2013, Chinese Application No. 201320711701.7 filed Nov. 12, 2013, Chinese Application No. 201420165185.7 filed Apr. 4, 2014, and U.S. Provisional Application No. 62/008,281 filed Jun. 5, 2014. The entire disclosures of each of the above applications are incorporated herein by reference.

FIELD

The present disclosure generally relates to illumination devices and, more particularly, to illumination devices such as flameless electric candles, etc.

BACKGROUND

This section provides background information related to the present disclosure which is not necessarily prior art.

Conventional candles are typically constructed from wax and include wicks embedded therein. In use of the candles, the wicks can be ignited to produce flames that provide heat, light, etc.

SUMMARY

This section provides a general summary of the disclosure, and is not a comprehensive disclosure of its full scope or all of its features.

Exemplary embodiments of the present disclosure generally relate to illumination devices (e.g., electric candles, etc.). In one exemplary embodiment, an illumination device generally includes a housing, a light source, a pendulum supporting the light source, a support member coupled to the housing and the pendulum, and a driving device coupled to the pendulum and configured to produce the pivotal movement of the pendulum. At least a portion of the pendulum is disposed within the housing, and the support member is configured to allow pivotal movement of the pendulum and light source relative to the housing.

In another exemplary embodiment, the illumination device includes an electric candle. In this embodiment, the electric candle generally includes a housing, a light source, and a color element positioned over at least part of the light source for creating a color effect in the illumination device when the light source transmits light through the color element.

In still another exemplary embodiment, the illumination device includes an electric candle. In this embodiment, the electric candle generally includes a housing, a head (e.g., having a flame shape, etc.), a light source disposed within the head, a pendulum supporting the light source and the head, and a driving device configured to produce pivotal movement of the pendulum to thereby move the head and the light source relative to the housing. The pendulum is pivotally coupled to the housing and is configured to move the head and the light source relative to the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 18:
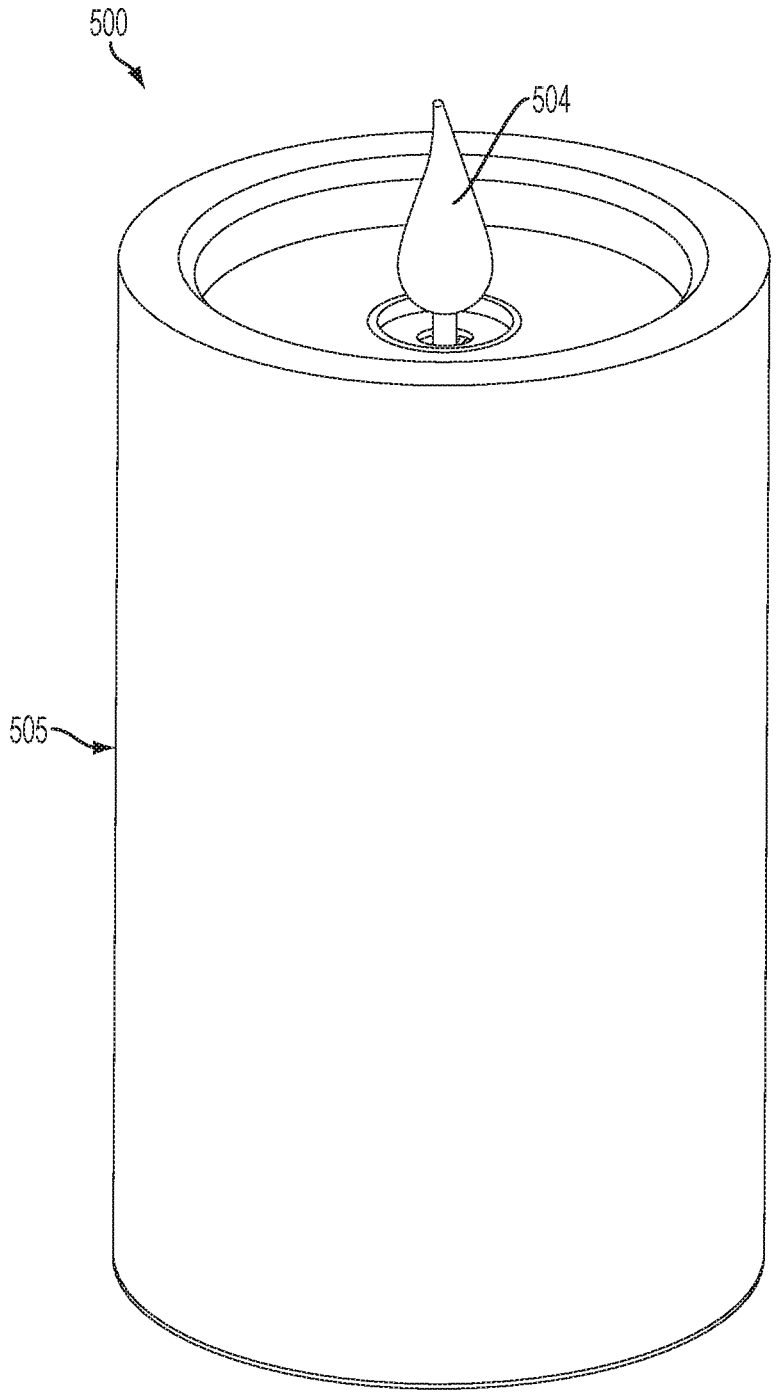
Figure 19:
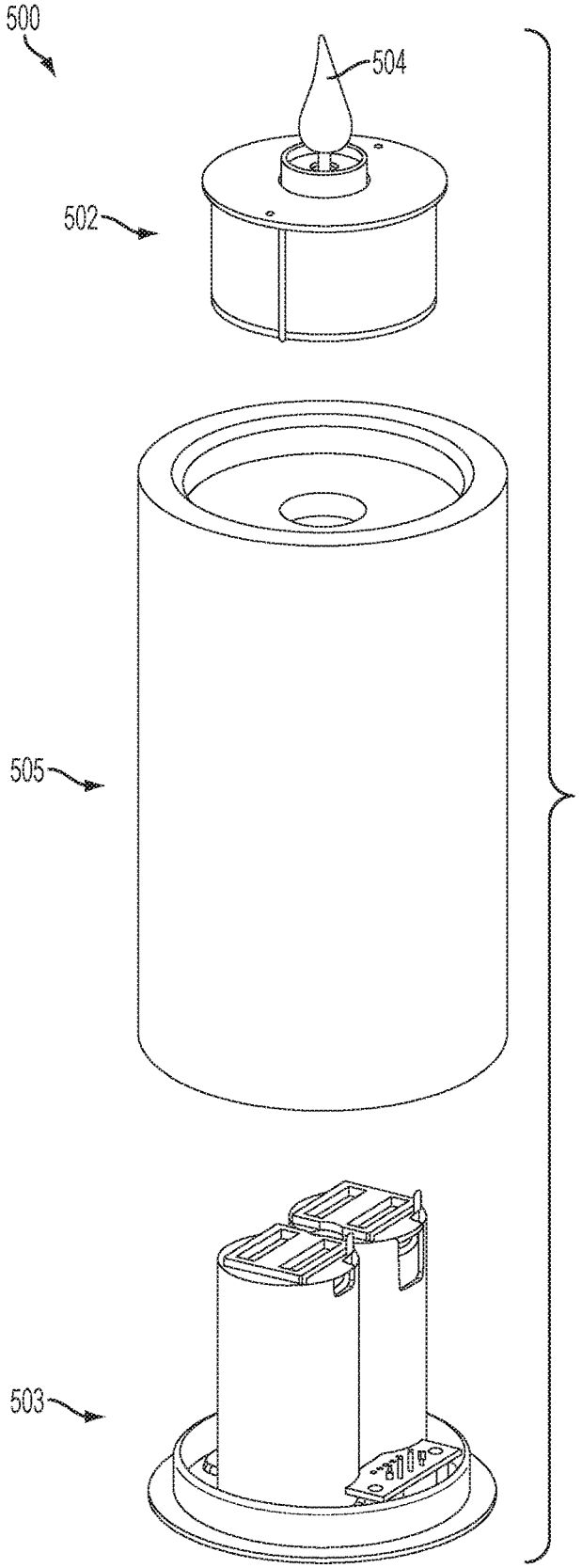
Figure 20:
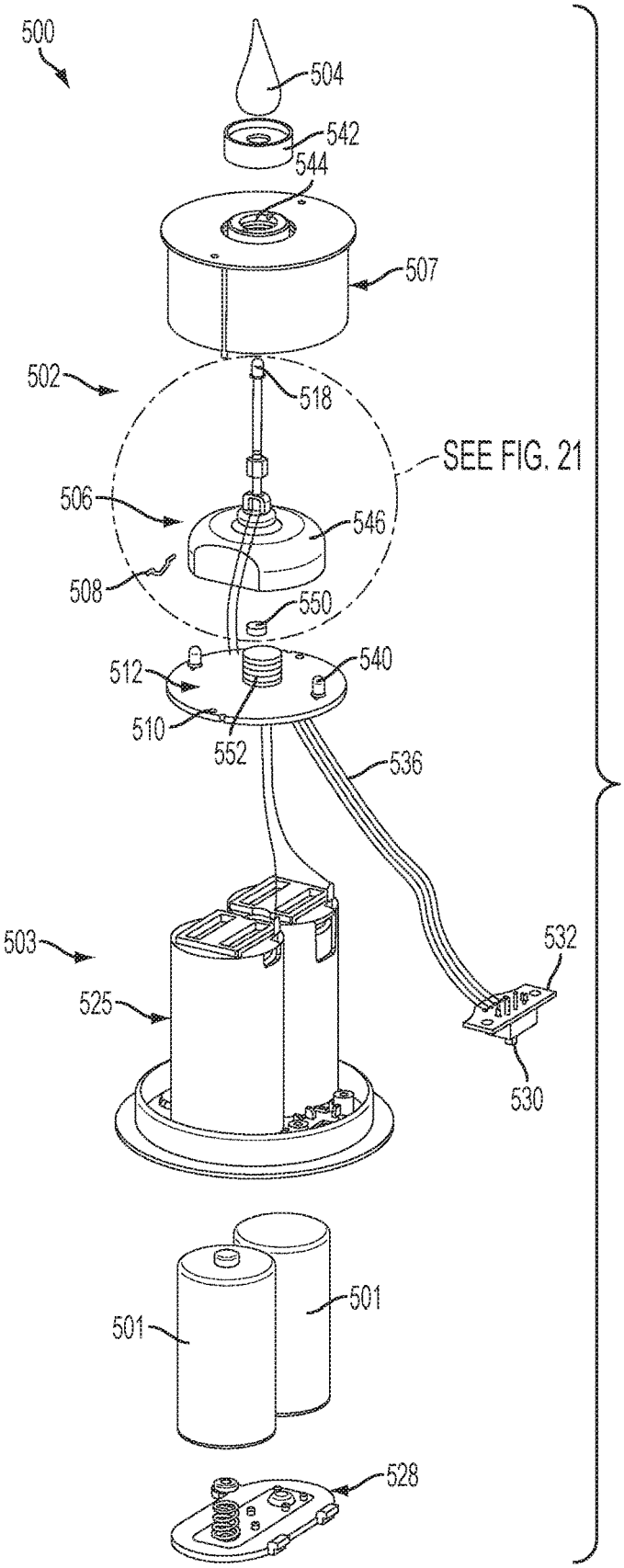
Figure 21:
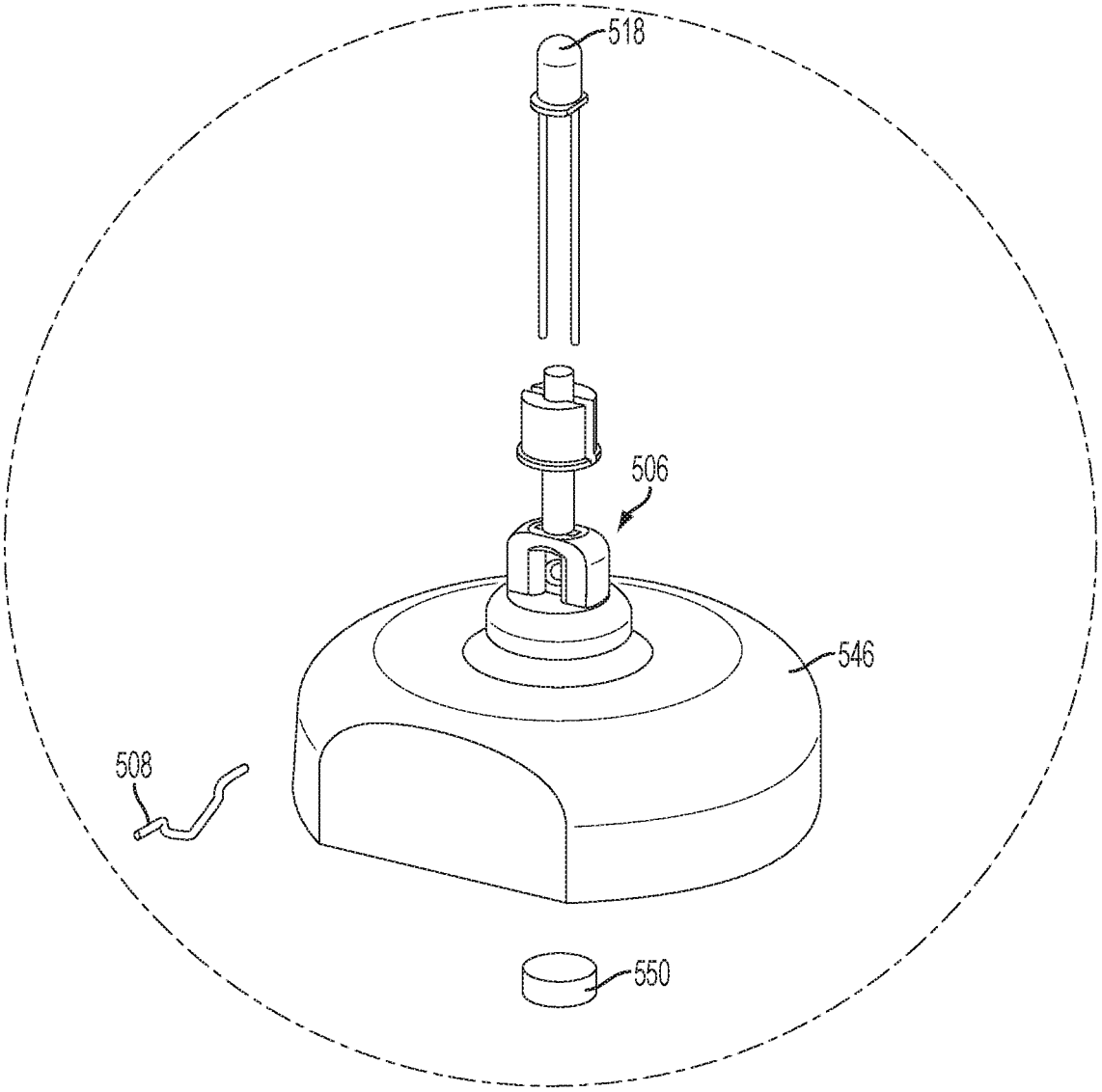
Figure 22:
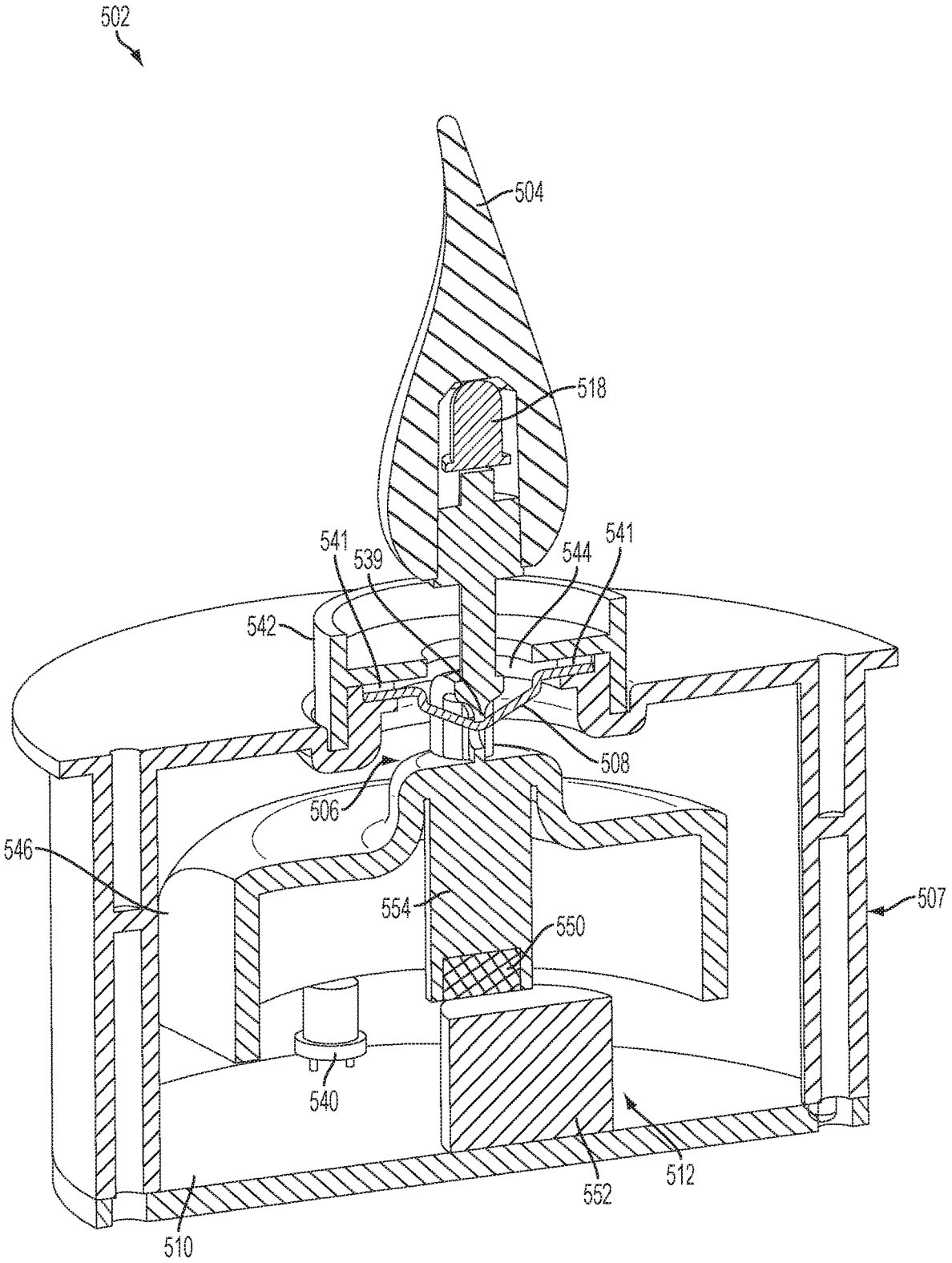

FIG. 18 a perspective view of another exemplary embodiment of an illumination device according to the present disclosure;

FIG. 19 is an exploded perspective view of the illumination device of FIG. 18;

FIG. 20 is another exploded perspective view of the illumination device of FIG. 18;

FIG. 21 is an enlarged view of a portion of the illumination device of FIG. 20; and FIG. 22 is a section view of a functional module of the illumination device of FIG. 18, with portions removed to show internal construction;

Corresponding reference numerals indicate corresponding parts throughout the several views of the drawings.

DETAILED DESCRIPTION

The inventor hereof has developed, and discloses herein, exemplary embodiments of illumination devices. In various aspects, the illumination devices generally include electric candles (e.g., electric swing-flame candles, etc.). But it should be appreciated that the illumination devices may include devices other than the electric candles within the scope of the present disclosure (e.g., may take forms other than candles, etc.).

Exemplary embodiments of the illumination devices generally include housings (e.g., outer portions, external portions, shells, covers, etc.), light sources (e.g., light emitting diode (LED) lights, etc.), pendulums, support members, and driving devices. In some aspects, the pendulums support the light sources, and the support members allow for pivotal movement of the pendulums (and the light sources) relative to the housings. And, the driving devices (which may include, without limitation, motors (e.g., vibrating motors, polarizing motors, etc.); magnetic assemblies; pressure differentials; other driving devices, etc.) are configured to produce the pivotal movement of the pendulums.

In some aspects, the support members of the illumination devices include wires extending through interior regions of the housings and supporting the pendulums. The wires may be constructed from suitable materials including, for example, materials that are non-metallic, non-rigid (e.g., soft, etc.), other materials, etc. In addition, the wires may have suitable sizes including, for example, diameters of about one millimeter or less (e.g., diameters of about one millimeter, diameters of about 0.5 millimeters, diameters of about 0.2 millimeters, diameters less than about 0.2 millimeters, diameters therebetween, etc.), thereby allowing the pendulums to pivot (e.g., swing, etc.), on the wires, when driven by the driving devices.

In some aspects, the illumination devices also include heads coupled with the pendulums. The light sources may be disposed within the heads (e.g., within cavities defined within the heads, etc.), so that light from the light sources can be at least partly transmitted through the heads to provide a flame effect (e.g., a flame-shaped light, a flame-shaped lighting effect, etc.) to the illumination devices. As such, the heads may be constructed from suitable materials (e.g., plastics, rubber, silicon, etc.), and may be at least partly transparent, translucent, opaque, etc. In addition, in some aspects the illumination devices further include color elements positioned over at least part of the light sources (and, in some cases, positioned within the heads (although they may alternatively be positioned outside of the heads in some embodiments, or may be formed integrally with the heads in some embodiments)) for creating a color effect in connection with the flame effect. The color elements may include any suitable shapes, including, without limitation, tube-shaped sleeves, rings, lampshade shapes, etc. In addition, the color elements may include desired colors, for example, generally blue colors or other colors (e.g., orange and/or red colors, etc.). Further, the color elements may be transparent, translucent, etc. and/or may be made of plastic, rubber, silicon, etc.

Additionally, in various aspects, the illumination devices use printed circuit boards (PCBs), which generally contain electrical wirings, to electrically connect (and/or power and/or control) the light sources and/or the driving devices, to thereby control operation of the light sources and/or the driving devices. In some aspects, the PCBs further include (e.g., are part of, are associated with, etc.) printed circuit board assemblies (PCBAs) to provide power to the light sources and/or the driving devices, and to control operation of the illumination devices. The PCBAs generally contain electronic components (e.g., resistors, capacitors, diodes, transistors, etc.) in addition to electrical wirings. And, in some aspects, at least two wires are used to electrically connect the PCBs to the PCBAs. Here, each of the at least two wires can include suitable sizes and, for example, may have diameters of about 0.5 millimeters or less (e.g., diameters of about 0.5 millimeters, diameters of about 0.2 millimeters, diameters of about 0.15 millimeters, diameters of about 0.1 millimeters, diameters less than about 0.1 millimeters, etc.). In addition, due to the generally small size of the wires, each of the at least two wires may include lacquered wires, or metal wires without any coating (e.g. without plastic or rubber outer layers).

With reference now to the drawings, FIGS. 1-8 illustrate an exemplary embodiment of an illumination device 100 including one or more aspects of the present disclosure. In this embodiment, the illumination device 100 is illustrated as an electric candle (e.g., an electric swing-flame candle, etc.). However, it should be appreciated that the illumination device 100 may have other configurations, other than electric candles, in other embodiments.

Figure 1:
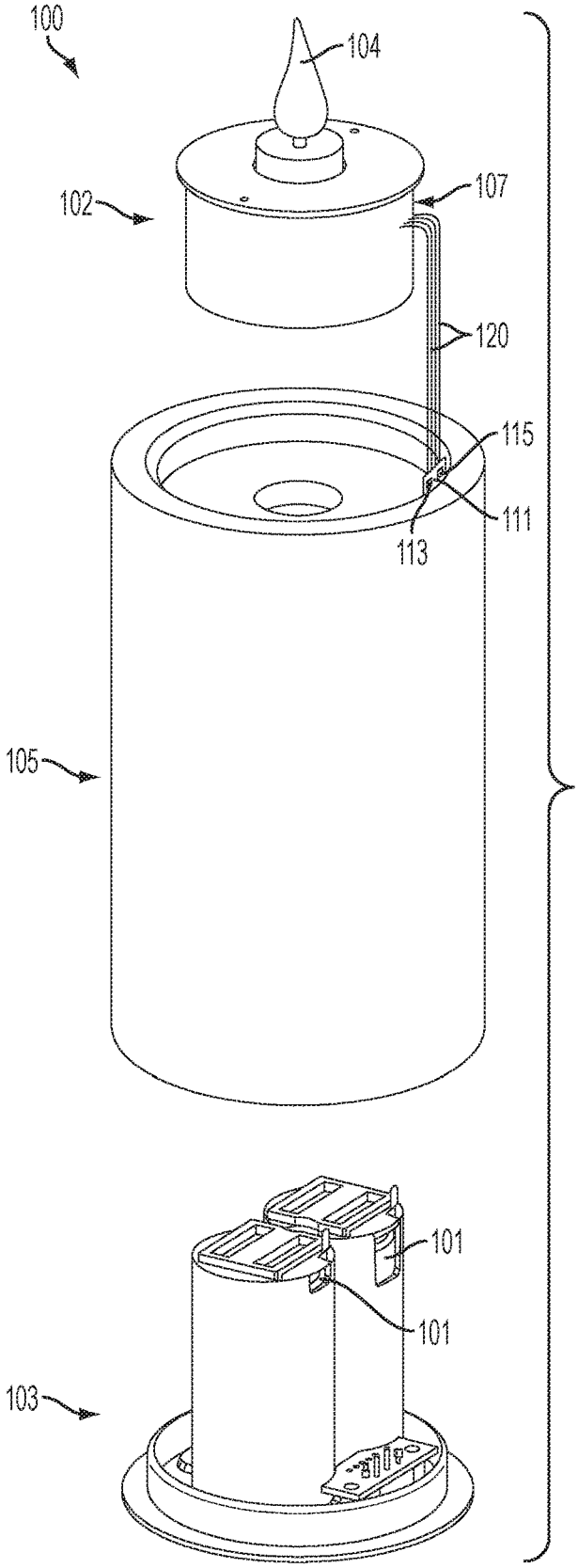
FIG. 1 is a perspective view of an exemplary embodiment of an illumination device according to the present disclosure.

As shown in FIG. 1, the illumination device 100 generally includes a functional module 102 and a battery compartment 103. And, the functional module 102 and the battery compartment 103 are configured to couple to a shell 105. Batteries 101 (broadly, a power supply) provide power to the illumination device 100, and are coupled to the battery compartment 103 and are configured to position within the shell 105 when the battery compartment 103 couples to the shell 105.

The functional module 102 generally includes a head 104 and a housing 107. The head 104 is located generally above the housing 107. The head 104 is designed to generally have a shape like a burning flame (e.g., a flame-shaped head). In addition, the head 104 defines a generally three-dimensional shape (as opposed to other devices that have heads with generally two-dimensional shapes (e.g., fin 404 in FIGS. 15-17)). However, the head 104 may have other shapes (e.g., circular, square, etc.) within the scope of the present disclosure.

Figure 2:
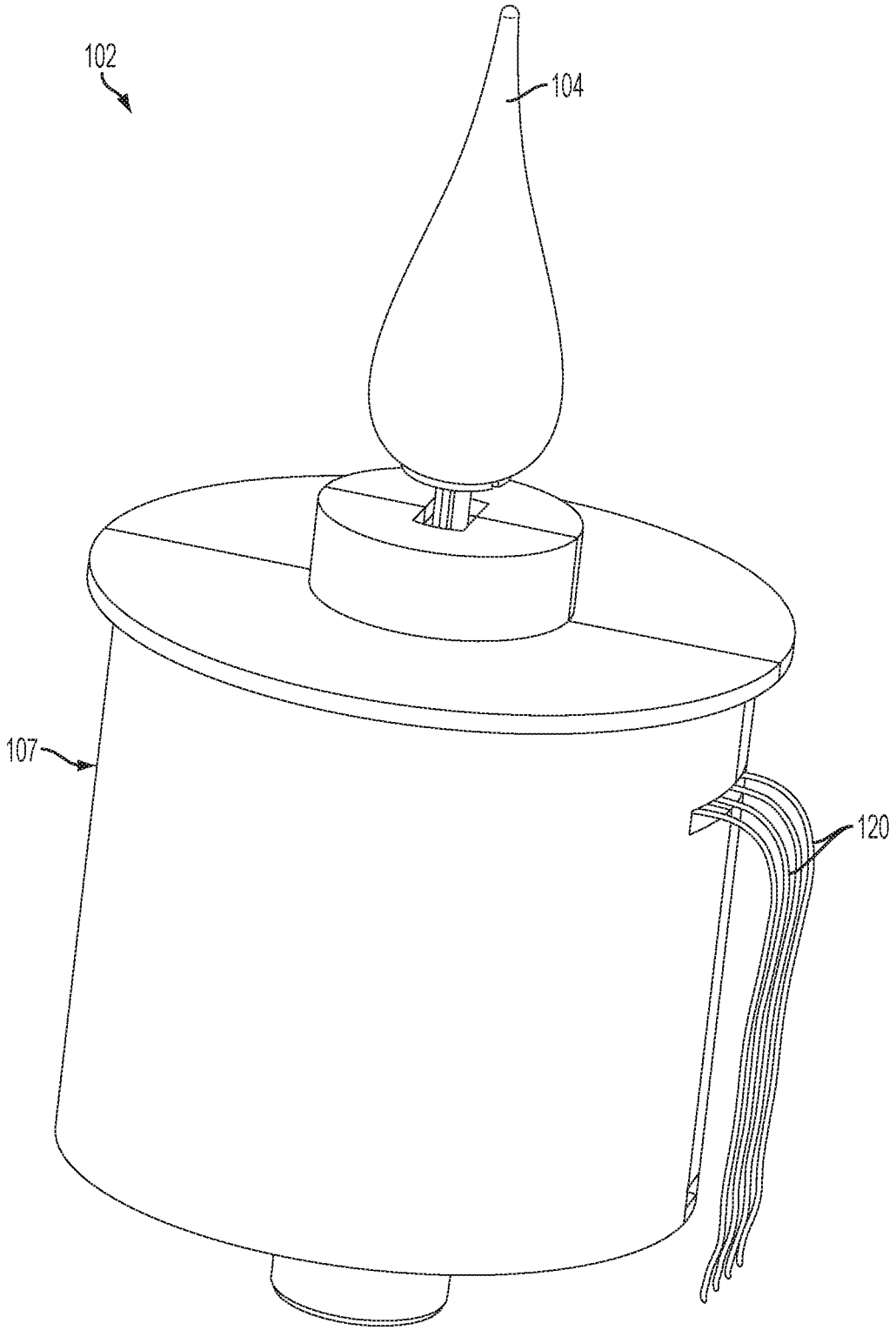
FIG. 2 is a perspective view of a functional module of the illumination device of FIG. 1.
Figure 3:
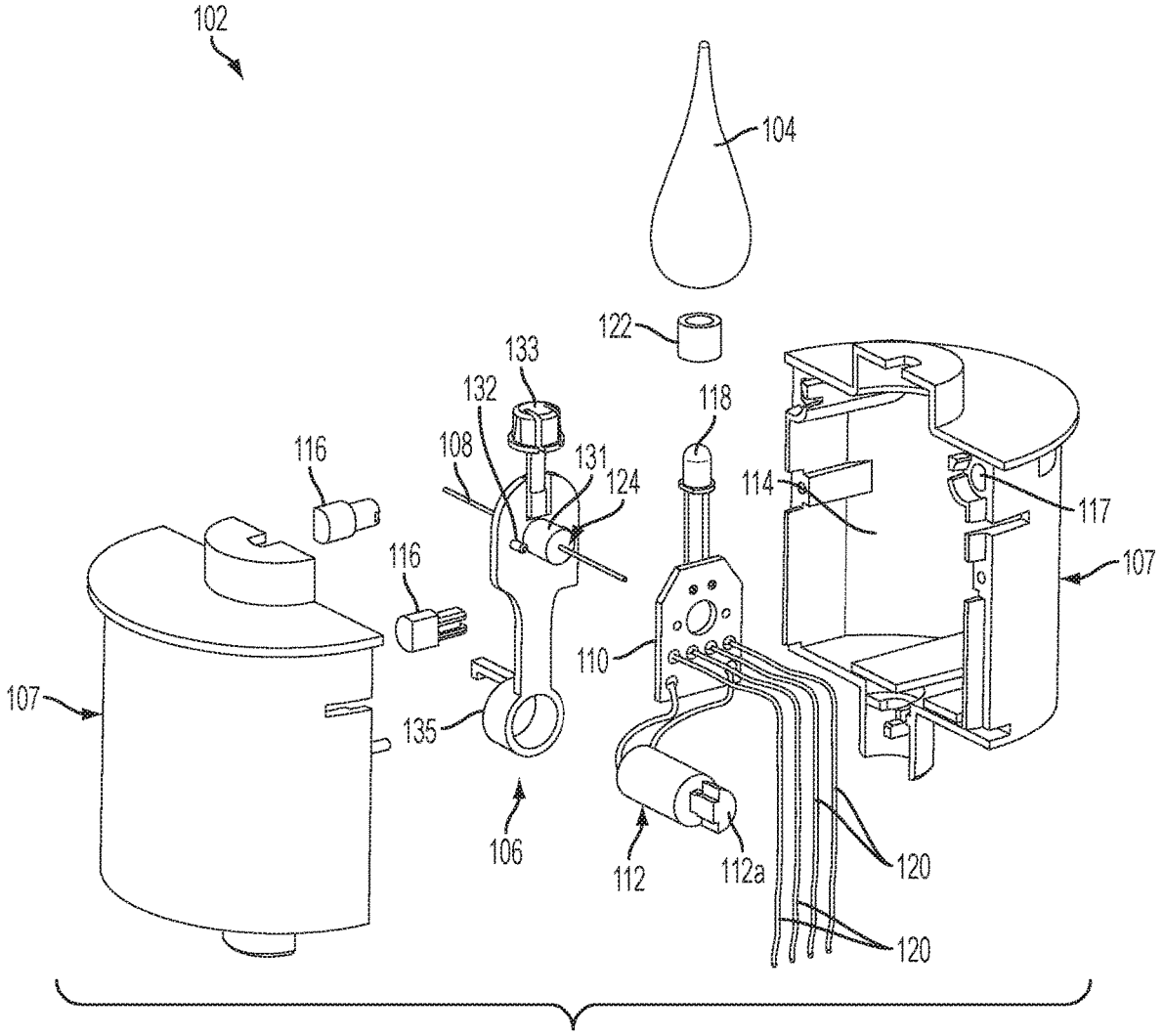
FIG. 3 is an exploded perspective view of the functional module of FIG. 2.
Figure 4:
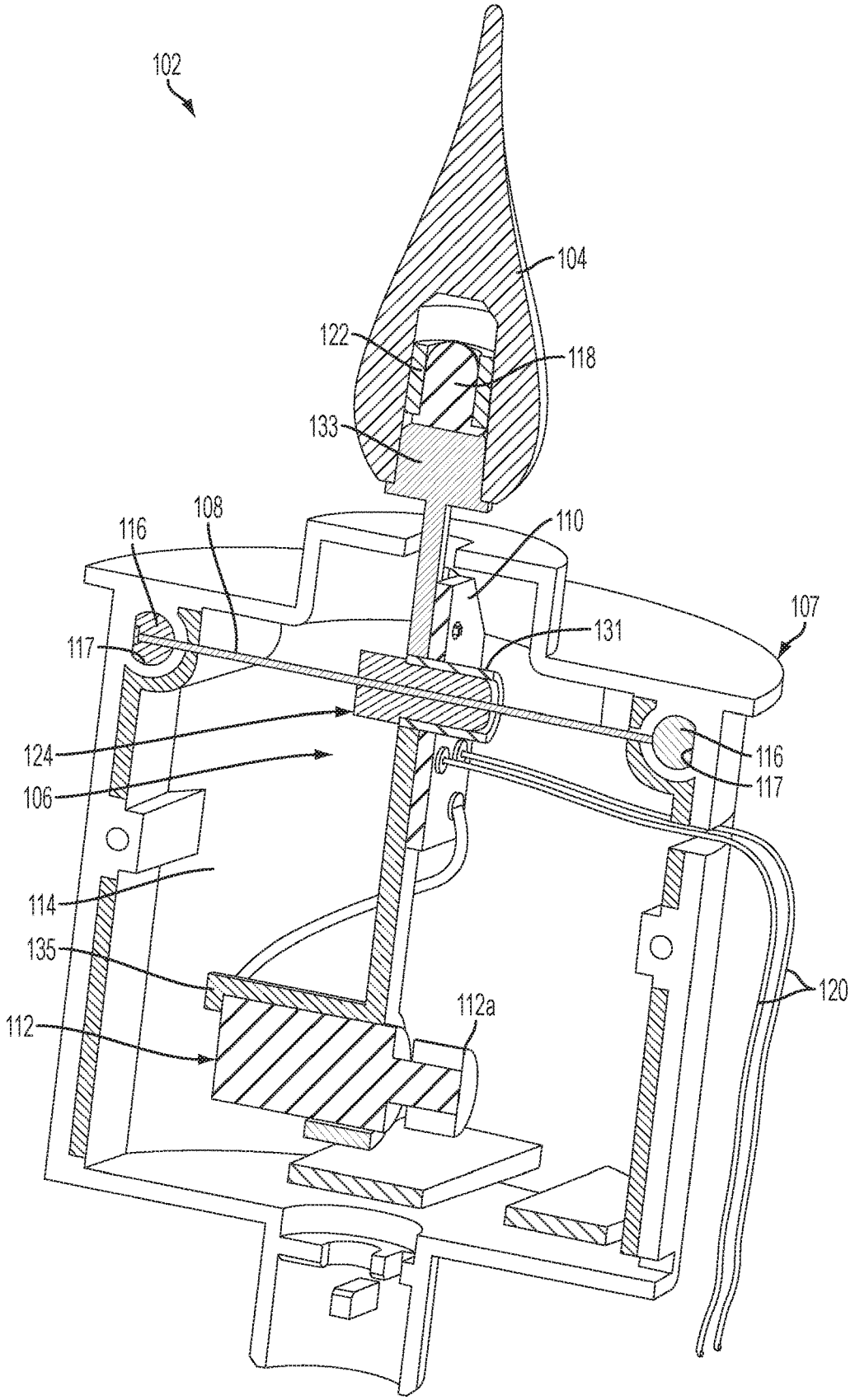
FIG. 4 is a section view of the functional module of FIG. 2, with portions of the functional module removed to show internal construction.
Figure 5:
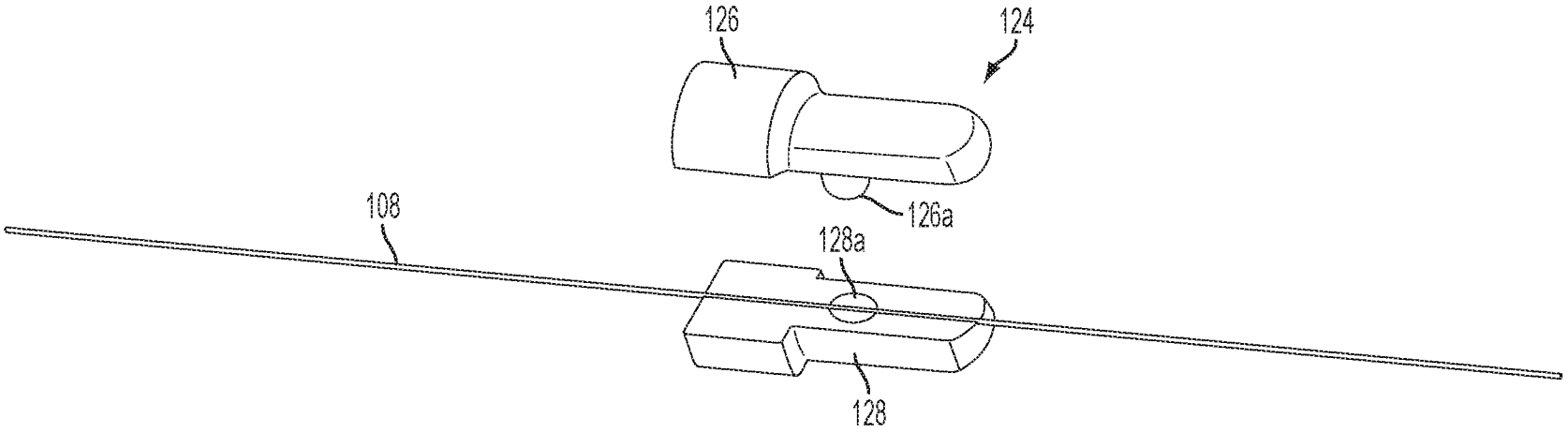
FIG. 5 is a perspective view of a support member of the illumination device of FIG. 1.
Figure 6:
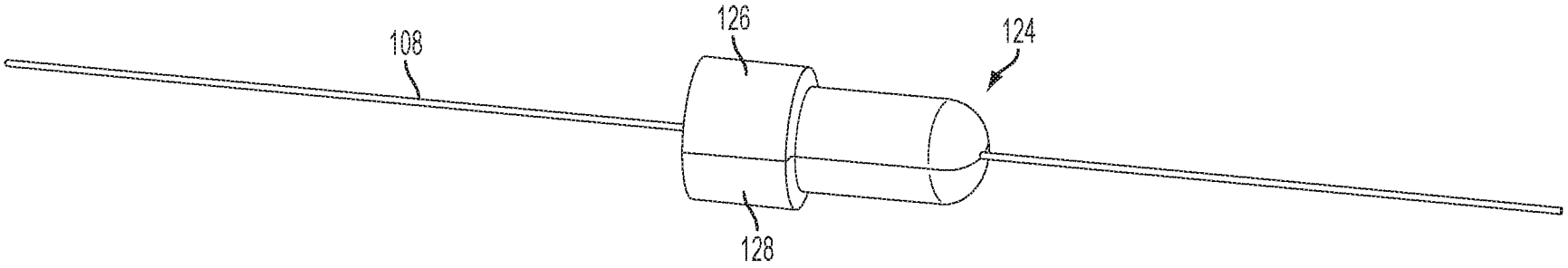
FIG. 6 is another perspective view of the support member of FIG. 5.

With additional reference to FIGS. 2-4, the functional module 102 of the illumination device 100 also includes a pendulum 106, a support member 108 (e.g., a wire, etc.) coupled to the housing 107 and supporting the pendulum 106, and a driving device 112. The driving device 112 is coupled to the pendulum 106, via a mount 135, and is generally disposed in an interior region 114 of the housing 107. The pendulum 106 is coupled with the support member 108 at a location within the housing 107 (e.g., in the interior region 114 of the housing 107). As illustrated in this embodiment, the support member 108 extends through the interior region 114 of the housing 107 and supports the pendulum 106. And, end portions of the support member 108 are interference press-fit, by end mounts 116, within openings 117 of the housing 107 (only one opening 117 is visible in FIG. 3). When supported by the support member 108, and when not moving, the pendulum 106 generally hangs from the support member 108 in an equilibrium state, generally vertically under its own weight (and a weight of the driving device coupled thereto).

In the illustrated embodiment, the support member 108 generally includes a soft (non-metallic) wire having a diameter of about one millimeter (although the wire could have a diameter of less than one millimeter within the scope of the present disclosure, for example, about 0.5 millimeters, about 0.3 millimeters, about 0.2 millimeters, less than 0.2 millimeters, etc.). As an example, the wire may include a fishing line, etc. The wire extends tightly (e.g., under tension, etc.) across the interior region 114 of the housing 107 (e.g., generally linearly, without sag, without bend, etc.), and is held in this tight configuration by the end mounts 116. This can help support improved pivoting of the pendulum 106 on the wire (e.g., by reducing drag, friction, etc.). In addition, the generally small size of the wire (e.g., when the diameter of the wire is less than about 0.5 millimeters, less than about 0.3 millimeters, less than about 0.2 millimeters, etc.) helps facilitate, support, effect, produce, etc. smoother (and less stiff, less rigid, etc.) pivoting movement of the pendulum 106 on the wire (as compared to wires with larger diameters (e.g., greater than 1 millimeter, etc.)). Various benefits associated therewith are discussed herein.

The functional module 102 also includes a light source 118 and a color element 122 disposed toward a first end portion of the pendulum 106, and disposed within the head 104. In particular, the light source 118 is received within a fixture 133 of the pendulum 106. As such, the light source 118 can be supported by the pendulum 106 (e.g., snap-fit to the light source fixture, 133, etc.), and can extend within the head 104 (with the head 104 also supported by the pendulum 106 (e.g., coupled to (e.g., snap-fit to, etc.) the light source fixture 133, etc.)). The color element 122 is positioned over the light source 118 (and generally above the fixture 133). As such, the light source 118, the color element 122, and the head 104 are supported by the pendulum 106. In operation of the illumination device 100, the light source 118 is configured to transmit light, outwardly, through the color element 122 and through the head 104 to provide a flame effect (e.g., a flame-shaped light, a flame-shaped lighting effect, etc.) to the illumination device 100. The color element 122 is configured to create a color effect in connection with the flame effect of the illumination device 100.

In the illustrated embodiment, the light source 118 includes a light emitting diode (LED). Further, the LED may include a flickering LED preinstalled with a programmable circuit to cause various changes in intensity, color, etc. of the LED. However, other light sources may be used within the scope of the present disclosure. Also in the illustrated embodiment, the color element 122 is generally translucent and generally tube-shaped (but it could have other constructions).

The light transmitted generally outwardly from the head 104, via the light source 118, can be observed from different directions around the illumination device 100 (e.g., in a 360 degree range around the illumination device 100 and/or around the head, etc.), like a real candle flame. In addition, the illustrated color element 122 is generally blue in color to help give a realistic flame color to the light transmitted from the light source 118 through the head 104. As such, when the light source transmits light, the color element 122 further adds a blue color (broadly, the color effect) to the flame effect of the illumination device 100. In various designs, the color and number of the color element 122 and/or light source 118 may be varied according to specific requirements and/or desires. In some embodiment, the head 104 may be a particular color, in order to provide the color effect (in place of the color element 122), or in order to provide an additional color effect (in addition to color element 122). Further, the generally smooth pivoting movement of the pendulum 106 on the support member 108, as described above, helps facilitate, effect, produce, etc. movement of the light source 118 (and the head 104 and the color element 122) that is smoother, less stiff, less rigid etc. than in other devices, and that is also more vivid and more realistic (i.e., that imparts a more vivid and more realistic appearance to the light source 118 and the illumination device 100).

With additional reference to FIGS. 5-8, the functional module 102 of the illumination device 100 further includes an insert 124 configured to couple to the support member 108, and couple the support member 108 to the pendulum 106. The insert 124 includes first and second portions 126 and 128. The first and second portions 126 and 128 are configured to fit together over the support member 108 (e.g., with the support member 108 extending through channels of the portions 126 and 128, etc.) to thereby couple with the support member 108. In the illustrated embodiment, the support member 108 is generally captured (e.g., pinched, etc.) by a tab 126*a* of the first portion 126 within an opening 128*a* of the second portion 128. The first and second portions 126 and 128 may then be retained together on the support member 108 as desired, for example, by the tab 126*a* and opening 128*a*, or by another interference fit, a snap fit, a friction fit, mechanical fasteners, adhesive, etc.

Figure 7:
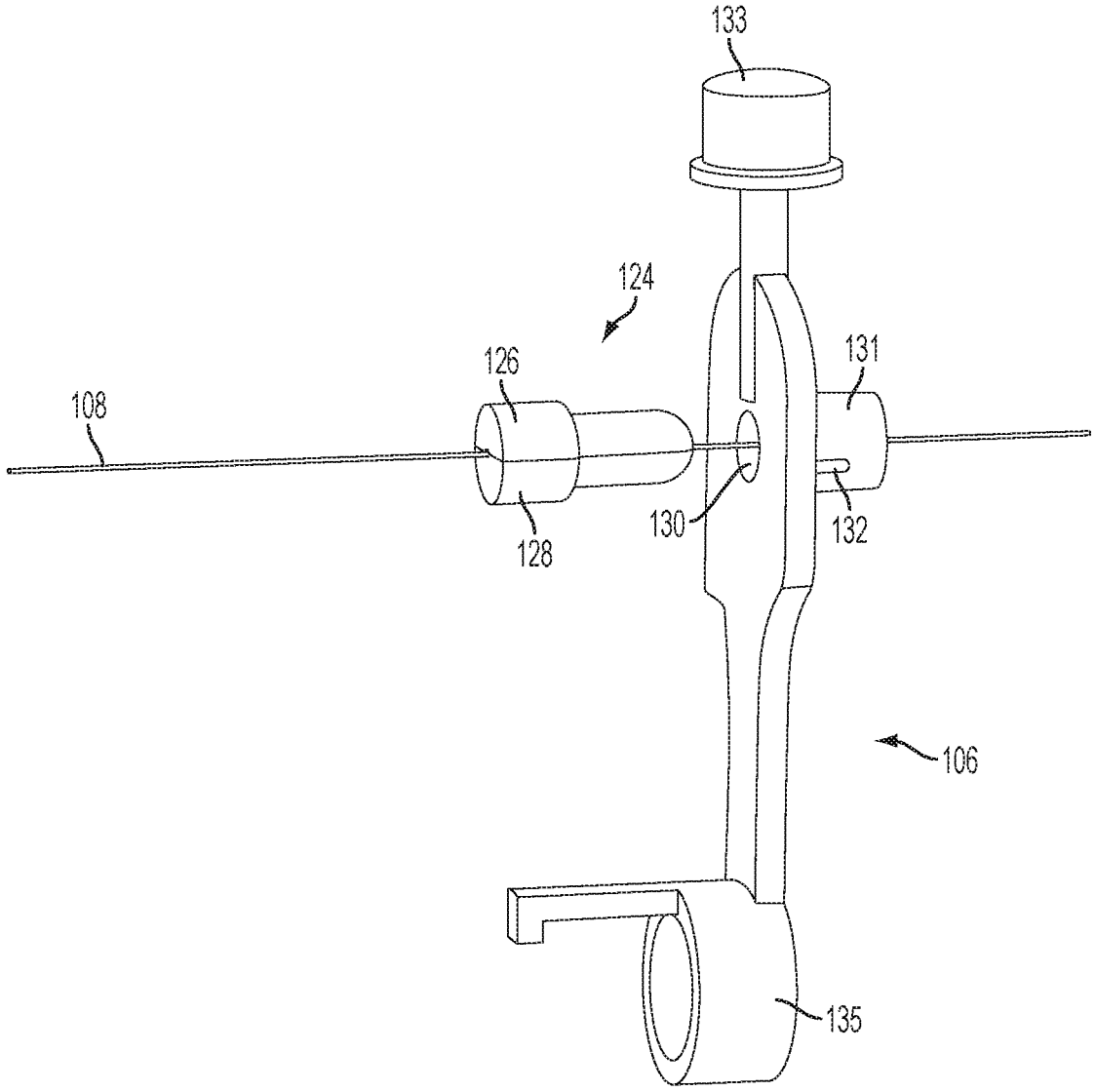
FIGS. 7 and 8 are perspective views illustrating installation of the support member of FIG. 5 to a pendulum of the illumination device of FIG. 1.
Figure 8:
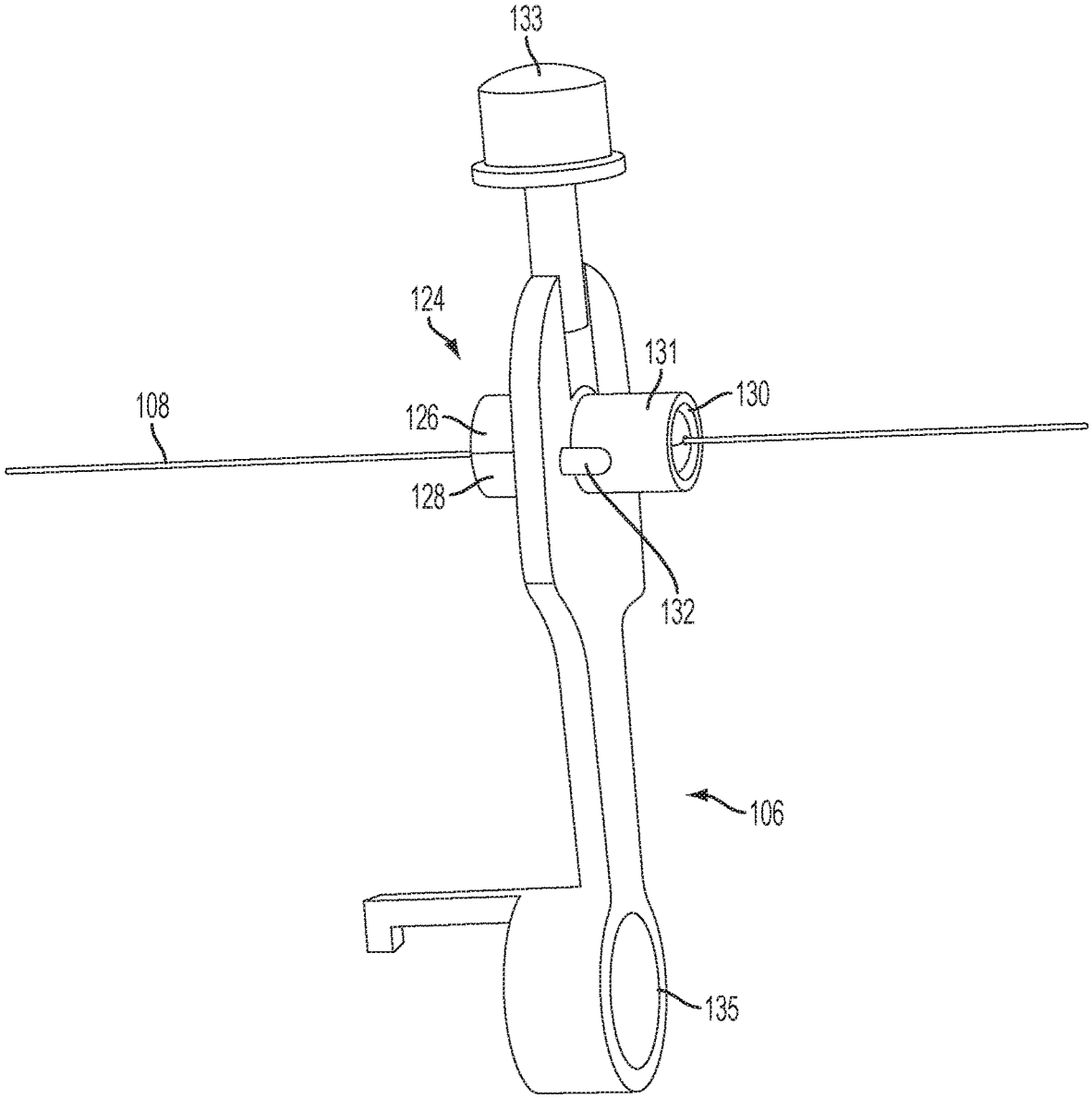

The insert 124, when coupled to the support member 108, is then configured to frictionally fit within a channel 130 (defined partly by protrusion 131) of the pendulum 106 (e.g., and extending generally through the pendulum 106, etc.) (FIGS. 7 and 8). The insert 124, along with the support member 108, frictionally fit with the pendulum 106 as a whole piece. Thus, in operation of the illumination device 100, there is generally no relative movement between the parts (between the pendulum 106, the insert 124, and the support member 108). For example, the pendulum 106 can be held in a desired position along the support member 108 without sliding therealong, etc. With that said, it should be appreciated that in some embodiments, the support member 108 and the insert 124 may be unitarily formed (e.g., monolithically formed, etc.) as a single component. Further, in some embodiments, the support member 108, the insert 124, and the pendulum 106 may be unitarily formed (e.g., monolithically formed, etc.) as a single component.

With reference again to FIGS. 3 and 4, the driving device 112 of the illumination device 100 is positioned toward a second end portion of the pendulum 106 (generally opposite the first end portion where the light source 118 is located). In particular, the driving device 112 is coupled to the pendulum 106, and positioned within the mount 135 of the pendulum 106 (and is oriented generally horizontally, and perpendicular to a longitudinal axis of the pendulum 106). As will be described more hereinafter, in operation, the driving device 112 is configured to cause pivoting movement (e.g., swing movement, etc.) of the pendulum 106, to thereby move the light source 118 and the head 104 (supported by the pendulum 106) relative to the housing 107. And, with the positioning of the driving device within the mount 135 of the pendulum 106, such movement of the pendulum 106 then also moves the driving device 112 with the pendulum 106.

In the illustrated embodiment, the driving device 112 includes an electric motor (e.g., a vibrating motor, etc.). As the motor operates (e.g., vibrates, etc.), lug 112*a* rotates and causes a weight of the motor to shift and swing the pendulum 106. Continued operation of the motor then builds and/or changes a momentum and/or a swinging intensity of the pendulum 106 (and the light source 118 and head 104 coupled thereto). As such, through operation of the motor and the resulting pivoting movement of the pendulum 106

(and the light source 118 and head 104 coupled thereto), the illumination device 100 can provide a moving effect (e.g., an illusion of a flickering and moving flame, etc.) to the light transmitted from the head 104 (as part of the overall flame effect, etc.). With that said, it should be appreciated that other driving devices 112 may be used.

A printed circuit board (PCB) 110 and a PCB assembly (PCBA) 111 (FIG. 1) are provided in the illumination device 100 to control operation thereof. The PCB 110 is disposed within the housing 107, as will be described more hereinafter. And, the PCBA 111 is disposed within the shell 105. The PCB 110 is electrically connected to the external PCBA 111 through wires 120. In the illustrated embodiment, four wires 120 are shown connecting the PCB 110 to the PCBA 111 (e.g., connecting the PCB 110 to control units on the PCBA 111, etc.). In other embodiments, however, more than or less than four wires may be used (e.g., one wire, two wires, three wires, five wires, greater than five wires, etc.) depending on required interconnections, power requirements, control requirements (e.g., depending on what control units, etc. are included), etc. In addition, in other embodiments, the PCB 110 and the PCBA 111 may be a single component, such that the PCB 110 is integrally part of the PCBA 111. Further, the PCB 110 and/or the PCBA 111 may include various electronic components (e.g., resistors, capacitors, diodes, transistors, combinations thereof, etc.), as desired, coupled to and/or formed directly onto the surface.

The PCB 110 (e.g., a lower portion of the PCB 110, etc.) is electrically connected with the driving device 112, via suitable wires. In this regard, the PCBA 111 includes a drive control unit 113 (broadly, a processing unit) (e.g., an integrated circuit such as an application specific integrated circuit (ASIC), a programmable logic circuit (PLC), etc.) that controls operation (e.g., vibration, operating time, operating frequency, etc.) of the driving device 112 and its operating (e.g., vibrating, etc.) frequency and time (through the PCB 110). Thereby the external force from the driving device 112 (coupled to the pendulum 106 via the mount 135) causes the pendulum 106 to pivotally move relative to the housing 107 along the support member 108 (e.g., at various different rates, at changing rates, at constant rates, etc.). For example, the drive control unit 113 may include programmable software (e.g., instructions, etc.) configured to control operation of the driving device 112 such as, for example, operating time, operating frequency, etc. The programmable software may include a customized program (e.g., customized instructions, etc.) to produce the desired operation of the driving device 112. With that said, in some aspects the desired operation of the driving device 112 may include, for example, a generally random operating frequency of the driving device 112 for helping produce the flame effect of the illumination device 100 (e.g., the moving effect of the light source 118, etc.). Various different suitable means (e.g., random number generating programs, etc.) can be used to generate the generally random operating frequency in a software program. For example, this can be achieved by calling a standard or third party library function and randomizing it with a value that is always changing, for example, the value of the current time, etc. In so doing, the generated sequences of frequencies lack any pattern, and thus appear random.

The PCB 110 (e.g., an upper portion of the PCB 110, etc.) is also electrically connected with the light source 118 of the illumination device 100, via suitable wires. For example, positive and negative electrodes of the light source 118 are coupled (e.g., welded, etc.) with terminals of the PCB 110. In this regard, the PCBA 111 includes a light source control unit 115 (broadly, a processing unit) (e.g., an integrated circuit, etc.) that controls the light source 118 (and any other light source(s) included in the illumination device 100), for example, causing the light source 118 to flash and vary in intensity with time, thereby to create a flickering effect (e.g., in place of or in connection with a flickering LED, etc.). For example, the light source control unit 115 may include programmable software (e.g., instructions, etc.) configured to control operation of the light source 118 such as, for example, operating time, operating intensity, etc. The programmable software may include a customized program (e.g., customized instructions, etc.) to produce the desired operation of the light source 118. In some aspects, the desired operation of the light source 115 may include, for example, a generally random operating intensity of the light source 115 for helping produce the flickering flame effect of the illuminating device 100. Again, various different means (e.g., random number generating programs, etc.) can be used to generate the generally random operating intensity in a software program. For example, this can be achieved by calling a standard or third party library function and randomizing it with a value that is always changing, for example, the value of the current time, etc. The generated sequences of intensities lack any pattern, and thus appear random.

With that said, it should be appreciated that, in some embodiments, the drive control unit 113 and the light source control unit 115 could be provided together as a single unit (e.g., as part of the PCBA 111, separate therefrom, etc.).

In the illustrated embodiment, the PCB 110 is coupled with the pendulum 106 at a location within the housing 107. The pendulum 106 includes the protrusion 131 and two pins 132 (only one pin 132 is visible in the drawings) that generally align with corresponding openings of the PCB 110. In some aspects, the portion of the pendulum 106 having the protrusion 131 and the pins 132 may be viewed as a fixing column, etc. The PCB 110 is coupled with the pendulum 106 by pressing, moving, etc. the protrusion 131 and the pins 132 through the corresponding openings of the PCB 110, to help hold the PCB 110 on the pendulum 106 (e.g., for fixing the position of the PCB 110 on the pendulum 106, etc.). The PCB 110 then moves (e.g., pivots, etc.) with the pendulum 106 during operation of the illumination device 100. Further, in order to avoid the impact to the movement of the pendulum 106, each of the wires 120 coupling the PCB 110 and the PCBA 111 has a generally small diameter of about 0.5 millimeter or less (e.g., about 0.3 millimeters, about 0.2 millimeters, etc.). In some embodiments, the wires 120 may also be lacquered. As described, this generally small size (and, in some cases, the lacquered construction) of the wires 120 reduces the impact of the wires 120 on the pivotal movement of the pendulum 106 (e.g., inhibits impact of the wires 120 on the movement of the pendulum 106 to the point that any impact is too little to be noticeable, etc.), such that the pendulum 106 can generally freely pivot.

In some embodiments, illumination devices may not include PCBs (e.g., PCB 110, etc.), but may include drive control units and/or light source control units (e.g., as part of PCBAs or separate therefrom, etc.). In these embodiments, wires coupling the drive control units to driving devises and/or wires coupling the light source control units to light sources may be generally small in diameter (e.g., about 0.5 millimeters or less (e.g., about 0.3 millimeters, about 0.2 millimeters, etc.), etc.) and/or may be lacquered, in order to avoid impact to movement of pendulums in the illumination devices.

As can be appreciated, the light source 118, transmitting light through the color element 122 and through the head 104, provides the appearance of a real flame to the illustrated illumination device 100, without the associated dangers (e.g., fire threat, smoke, etc.). In other words, the illumination device 100 provides a flameless, smoke-free light. In addition, the pivoting movement of the pendulum 106 in the illumination device 100, moving the light source 118, the color element 122, and the head 104, provides movement to the transmitted light that imitates (and, in some cases even increases or improves) flickering of a flame (e.g., provides a swing flame operation, etc.), with the pendulum 106 acting as a wick. As such, the illumination device 100 can provide a safe candle structure with a realistic flame effect that is more realistic than other currently available electronic products. Further, as previously stated, the head 104 of the illumination device 100 allows light transmitted from the light source 118 to be observed from different directions around the illumination device 100 (e.g., from all sides of the head 104, etc.), like a real candle flame (and in contrast to devices that include two dimensional fins reflecting light from only two side of the device). These features also apply to other embodiments of the present disclosure.

It should also be appreciated that additional light sources may be included in other portions of the illumination device 100 (e.g., at locations with the housing 107, within the shell 105, etc.), and coupled to the PCB 110 and/or PCBA 111, as desired.

Figure 9:
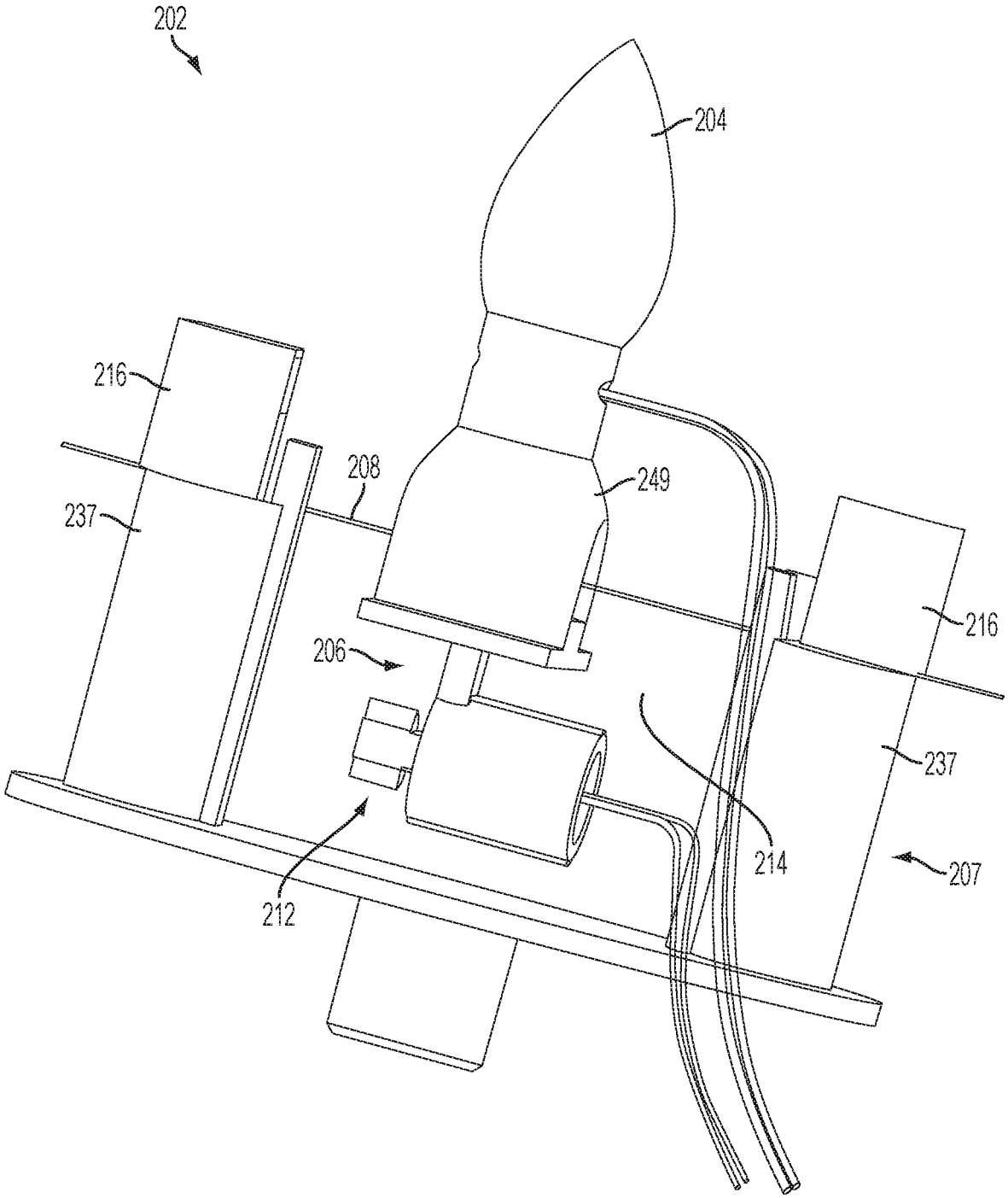
FIG. 9 is a perspective view of an exemplary embodiment of a functional module suitable for use in illumination devices of the present disclosure.
Figure 10:
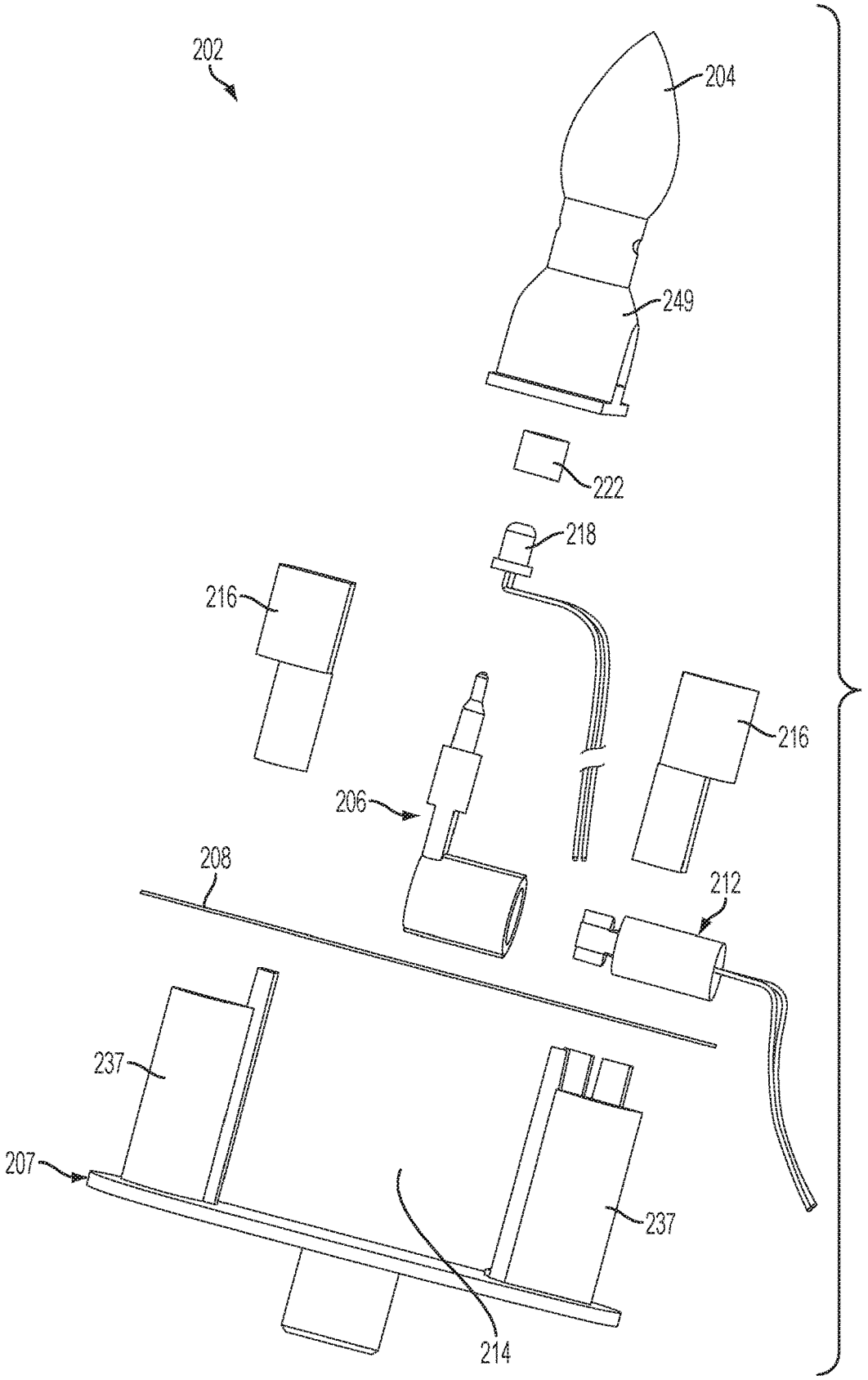
FIG. 10 is an exploded perspective view of the functional module of FIG. 9.
Figure 11:
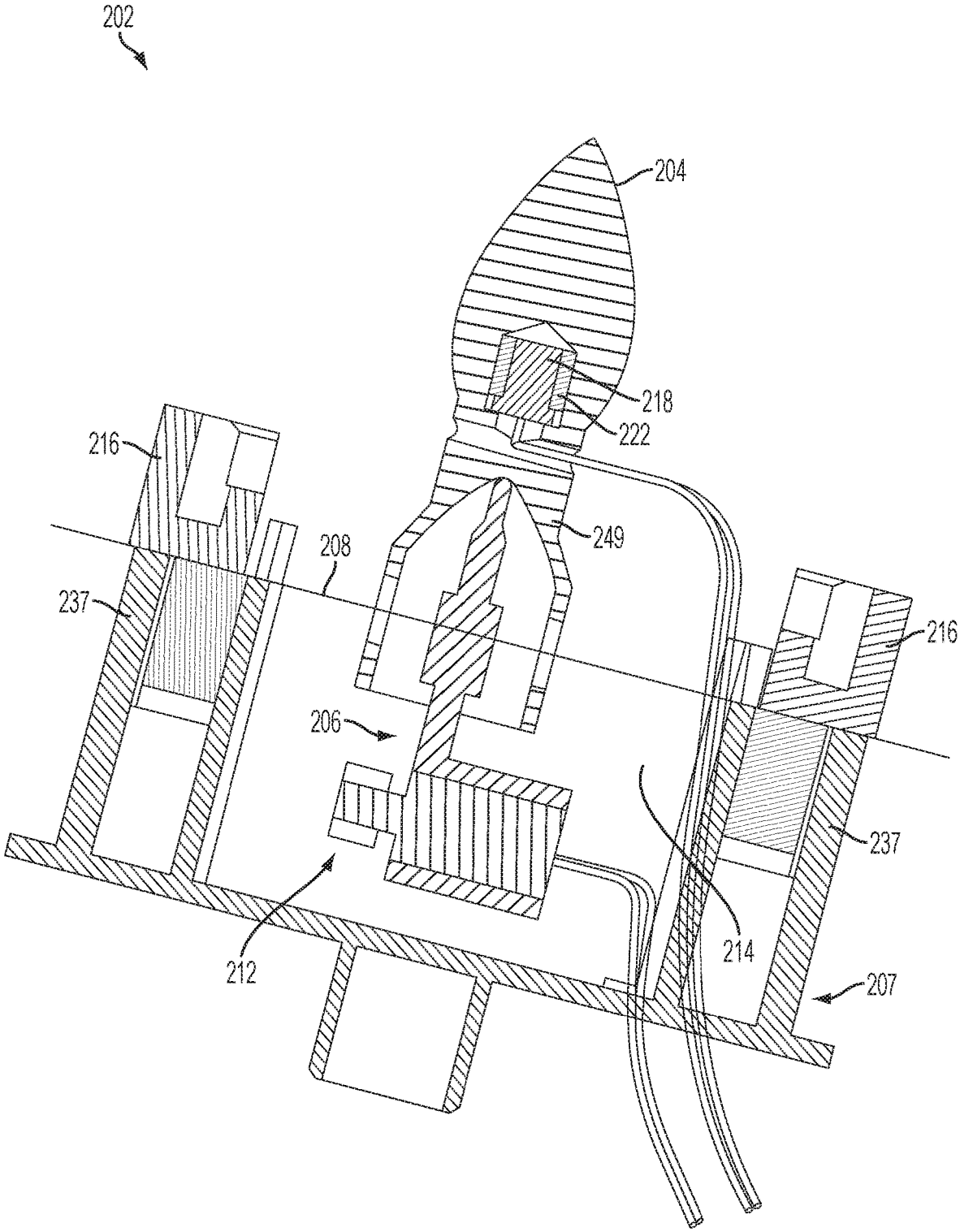
FIG. 11 is a section view of the functional module of FIG. 9.

FIGS. 9-11 illustrate an exemplary embodiment of a functional module 202 including one or more aspects of the present disclosure and suitable for use in an illumination device (e.g., illumination device 100, 300, 400, 500; other illumination devices of the present disclosure; other illumination devices; etc.). In this embodiment, the functional module 202 is again illustrated as an electric candle. However, it should be appreciated that the functional module 202 may be provided in other configurations, other than electric candles, in other embodiments.

The functional module 202 of this embodiment is similar to the functional module 102 of the illumination device 100 previously described and illustrated in FIGS. 1-8. For example, the functional module 202 generally includes a head 204 having a generally flame shape, a light source 218, a color element 222, a housing 207, a pendulum 206, a support member 208 coupled to the pendulum 206, a driving device 212, and a PCB. Again, these components are similar to those of the functional module 102, and can achieve similar technical results, such that a further description will not be provided.

In this embodiment, the housing 207 defines a generally symmetrical two-columnar shell. And, the support member 208 is coupled to the housing 207 by mounts 216 that pinch, hold, frictionally fit, etc. the support between the mounts 216 and columns 237 of the housing 207. Further, the illustrated support member 108 generally includes a soft (non-metallic) wire having a diameter of about one millimeter (although the wire could have a diameter of less than one millimeter within the scope of the present disclosure). The wire extends tightly (e.g., under tension, etc.) across an interior region 214 of the housing 207 (e.g., generally linearly, without sag, without bend, etc.), between the columns 237, and is held in this tight configuration by the mounts 216. This can help support improved pivoting of the pendulum 206 on the wire (e.g., by reducing drag, friction, etc.).

Also in this embodiment, the head 204 includes a sleeve 249 that extends over the pendulum 206, with the head 204 then supported by the pendulum 206. In particular, the head 204 is movably supported on the top of the pendulum 206. Thus the head 204 moves relative to the pendulum 206 when the driving device 212 causes pivoting movement of the pendulum 206.

Figure 12:
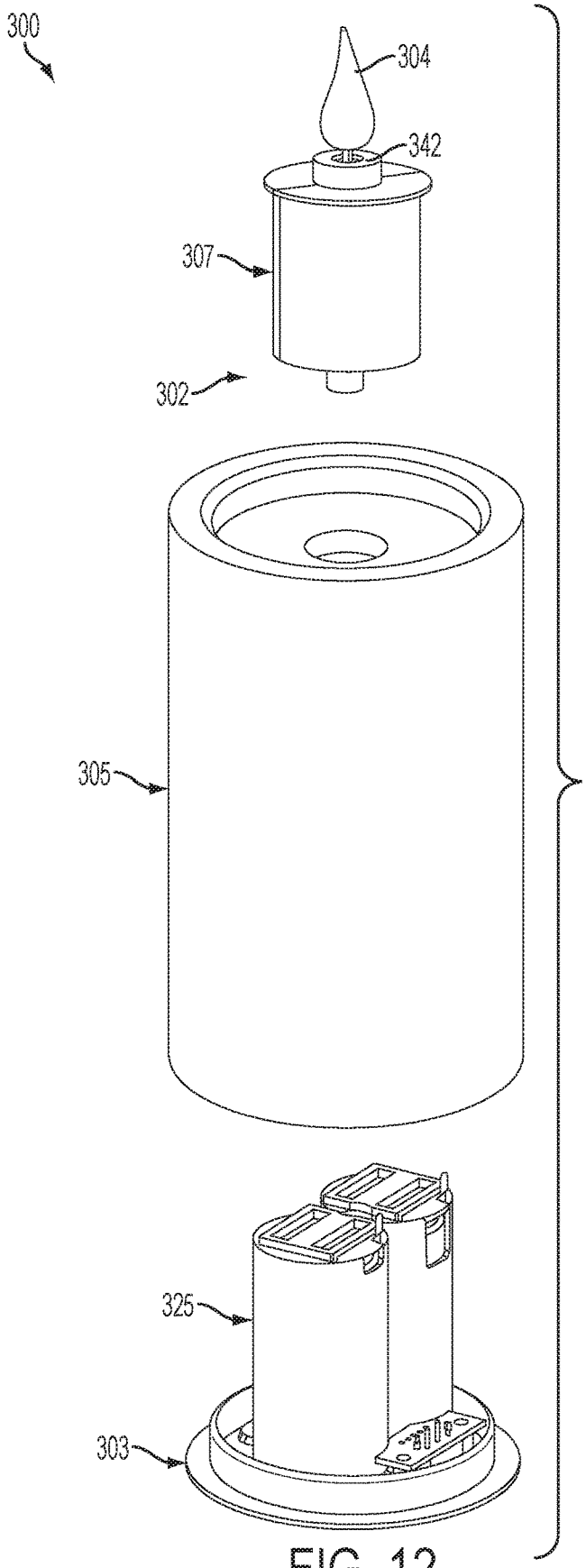
FIG. 12 is an exploded perspective view of another exemplary embodiment of an illumination device according to the present disclosure.
Figure 13:
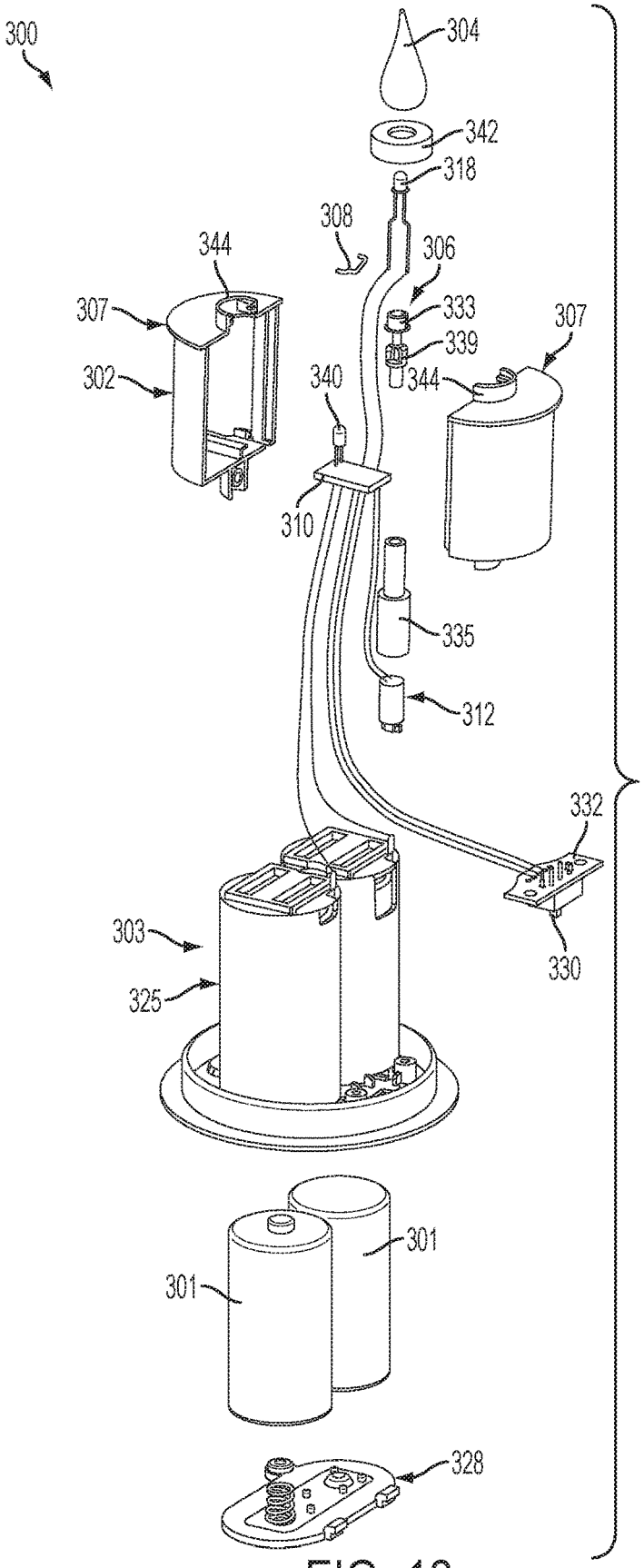
FIG. 13 is another exploded perspective view of the illumination device of FIG. 12, with a shell of the illumination device removed.
Figure 14:
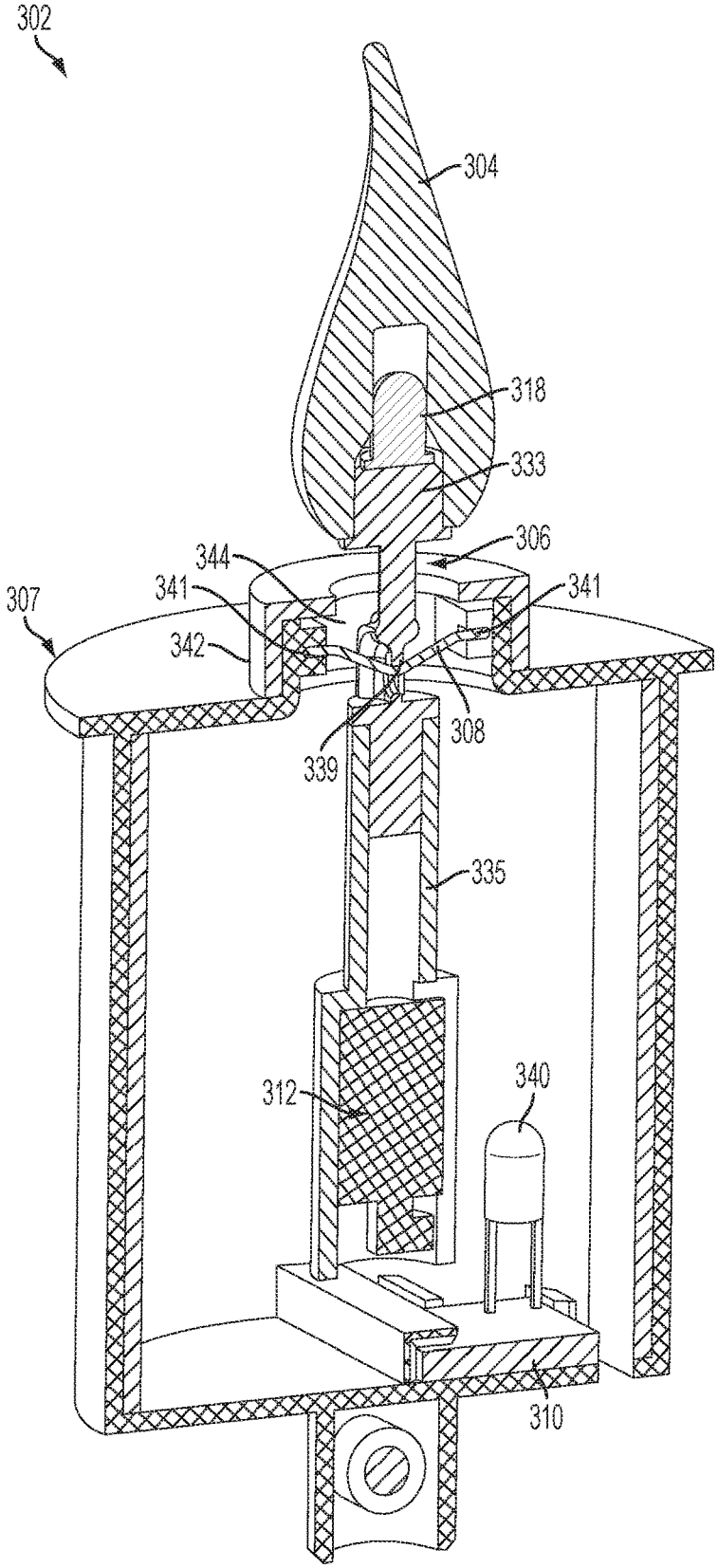
FIG. 14 is a section view of a functional module of the illumination device of FIG. 12, with portions of the functional module removed to show internal construction.

FIGS. 12-14 illustrate another exemplary embodiment of an illumination device 300 including one or more aspects of the present disclosure. In this embodiment, the illumination device 300 is again illustrated as an electric candle. However, it should be appreciated that the illumination device 300 may be provided in other configurations, other than electric candles, in other embodiments.

The illumination device 300 of this embodiment generally includes a functional module 302 and a battery compartment 303. The functional module 302 and the battery compartment 303 are configured to couple to a shell 305. And, similar to illumination device 100, the functional module 302 of the illumination device 300 generally includes a head 304 having a generally flame shape, a light source 318, a pendulum 306 supporting the light source 318 and head 304 (via fixture 333), a housing 307, a support member 308, a driving device 312, and a PCBA 310. These components are again also similar to those of the illumination device 100, and can achieve similar technical results, such that a further description will not be provided.

In the illustrated embodiment, the driving device 312 is again coupled to the pendulum 306 by a mount 335. But here, the driving device 312 is positioned generally vertically within the mount 335, and the mount 335 is then coupled (e.g., frictionally coupled, coupled via adhesive or other fasteners, etc.) to a lower portion of the pendulum 306.

Also in the illustrated embodiment, the pendulum 306 is supported by the support member 308 generally within the housing 307. And, end portions of the support member 308 couple to the housing 307 at fixing grooves 341 (FIG. 14) located along opposing sides of central opening 344 of the housing 307. In addition, the support member 308 includes a generally bent shaft, and the pendulum 306 includes a step 339 configured to receive the support member 308 (and allow pivoting movement of the pendulum 306 relative to the support member 308). Once assembled, a collar 342 is positioned generally around the opening 344 of the housing (e.g., to conceal the inner components of the functional module 302, etc.).

Further in this embodiment, the driving device 312 and the light source 318 are connected to the PCBA 310 by conducting wires so that the PCBA 310 can control operation of the driving device 312 and the light source 318. In order to reduce the resistance of and/or interference with the pendulum 306, the mount 335, and the driving device 312, when moving, each of the conducting wires may be a lacquered wire with a very small diameter. In addition, another light source (e.g., an LED, etc.) 340 is positioned on the PCBA 310 within the housing 307. The PCBA 310 also controls operation of the light source 340. And, the light source 340 is configured to illuminate an upper portion of the device 300 through the housing 307.

In this embodiment, the battery compartment 303 includes a battery cartridge 325, batteries 301, and a battery cover 328. The batteries 301 are disposed inside the battery cartridge 325. The PCBA 310 is electrically connected to electrodes of the battery cartridge 325 by connecting wires. The PCBA 310 is also electrically connected to a power switch 330 and a PCB switch 332. During operation of the illumination device 300, the batteries 301 supply power to the driving device 312 which then operates to move the pendulum 306. As an example, the driving device 312 may include a vibrating motor that vibrates inside the mount 335. And, the PCBA 310 may control the vibrating motor to vibrate intermittently. The external force from the vibration of the motor causes the pendulum 306, the light source 318, and the head 304 to move (e.g., pivot, etc.) relative to the housing 307 via the support member 308. Because the upper portion of the pendulum 306 is pivotally supported and the mount 335 has a very low barycenter, the head 304 (and the light source 318 therein) has very little resistance when it swings or moves. And, with the positioning of the motor within the mount 335 of the pendulum 306, such movement of the pendulum 306 then also moves the motor along with the pendulum 306.

Figure 15:
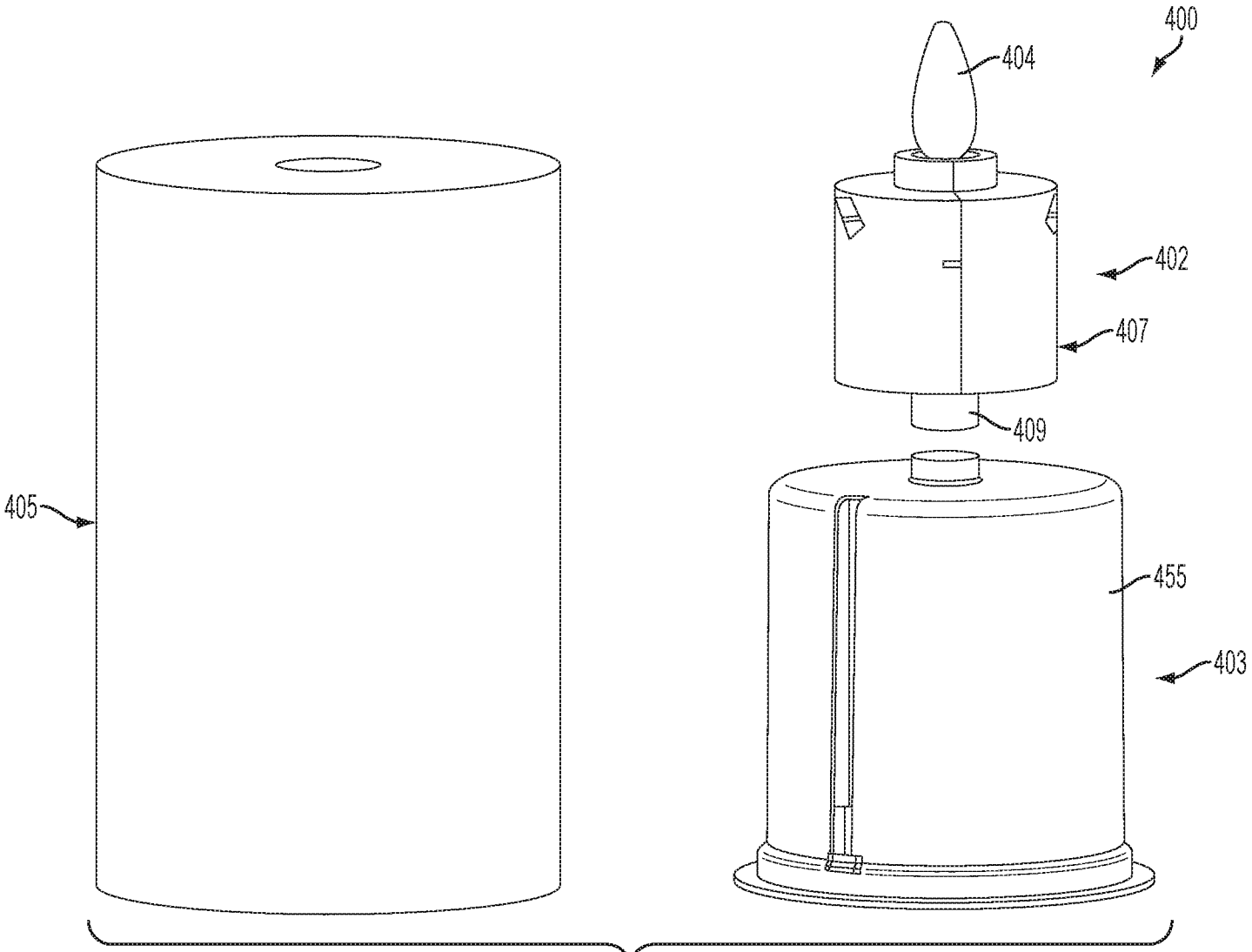
FIG. 15 is an exploded perspective view of still another exemplary embodiment of an illumination device according to the present disclosure.
Figure 16:
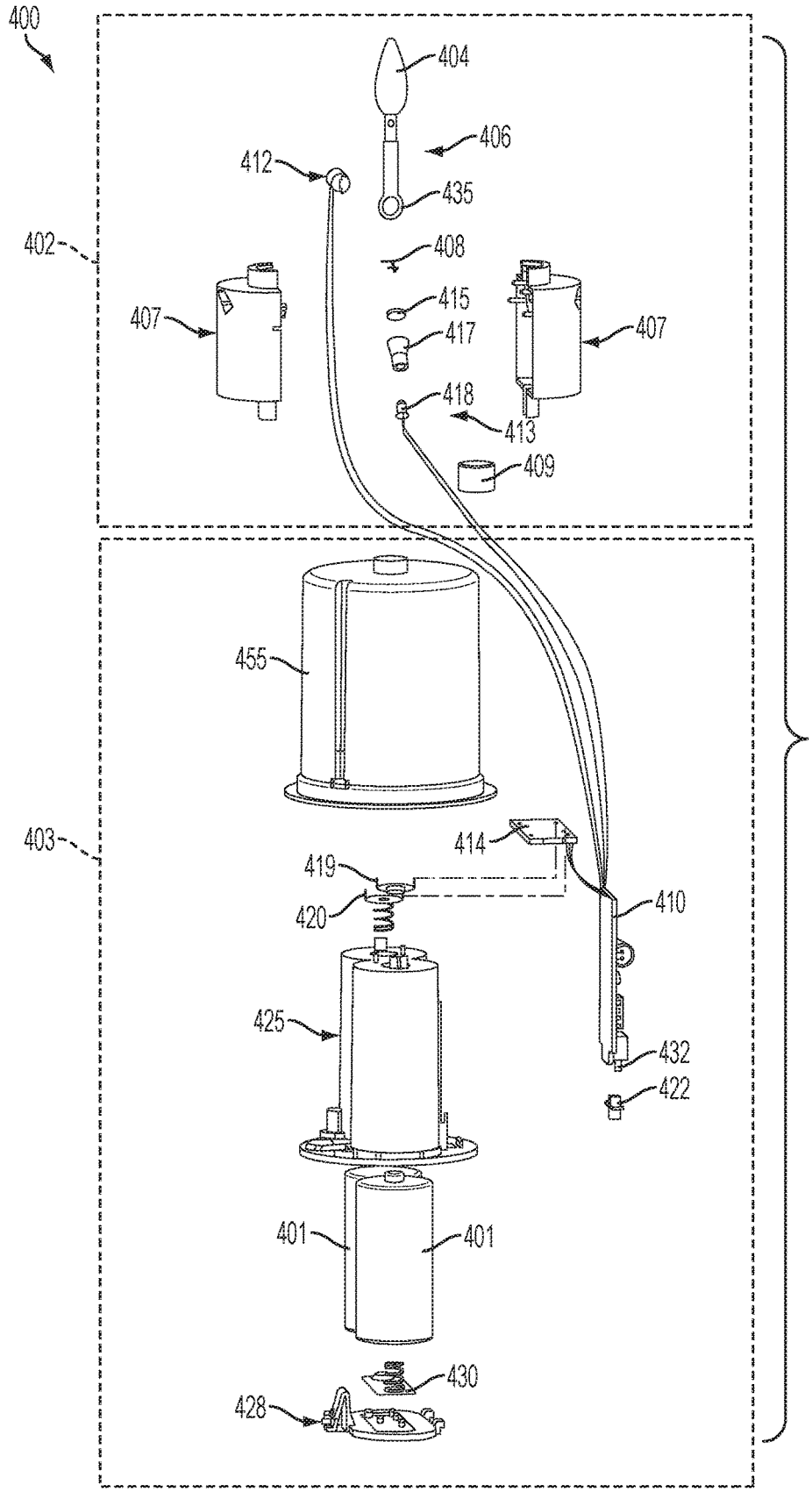
FIG. 16 is another exploded perspective view of the illumination device of FIG. 15.
Figure 17:
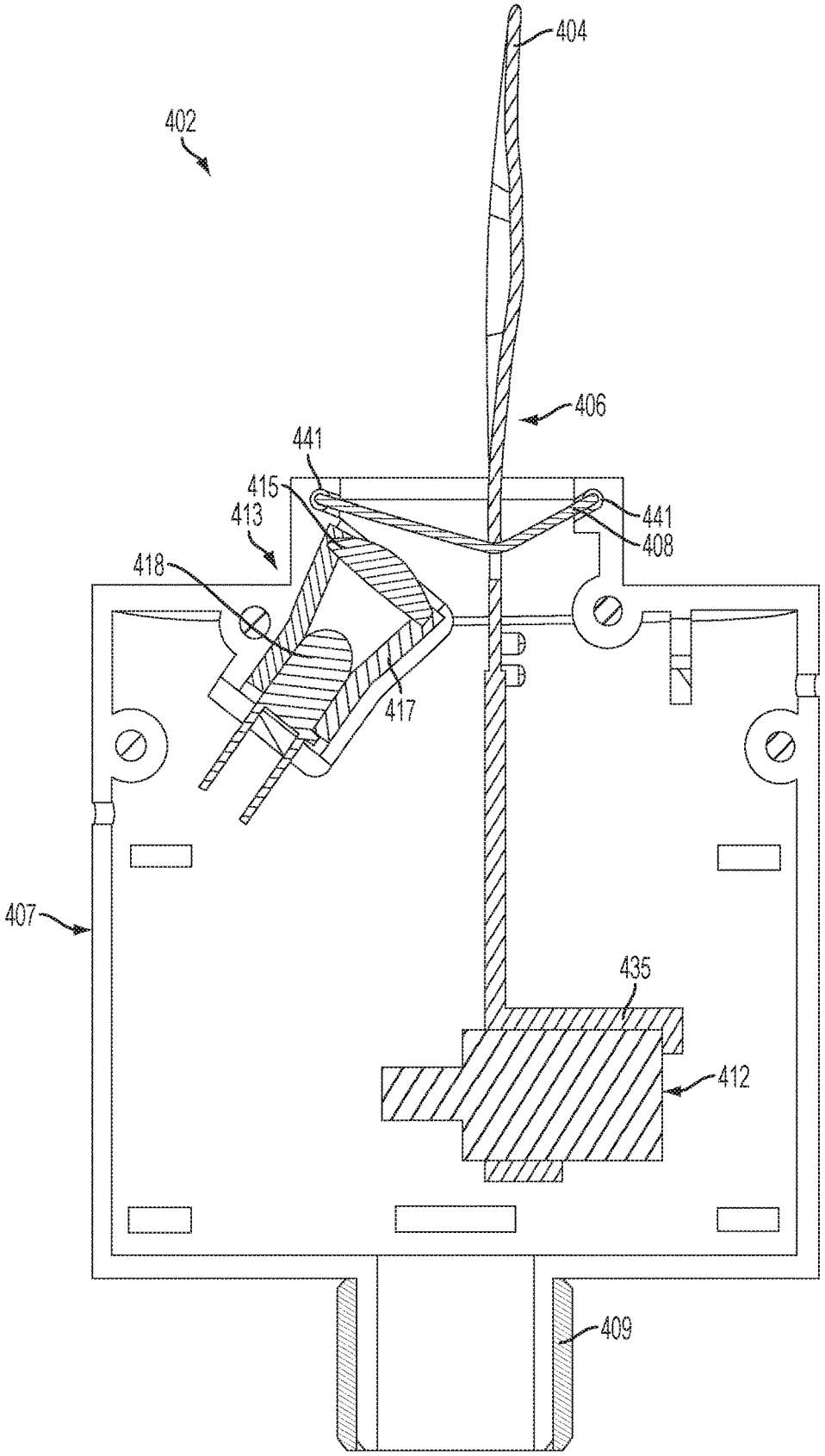
FIG. 17 is a fragmentary section view of a functional module of the illumination device of FIG. 15.

FIGS. 15-17 illustrate another exemplary embodiment of an illumination device 400 including one or more aspects of the present disclosure. In this embodiment, the illumination device 400 is again illustrated as an electric candle. However, it should be appreciated that the illumination device 400 may be provided in other configurations, other than electric candles, in other embodiments.

The illumination device 400 of this embodiment generally includes a functional module 402 and a battery compartment 403 electrically connected with the functional module 402. The functional module 402 and the battery compartment 403 are configured to couple to a shell 405. And, the shell 405, for example, can be wrapped with a layer of wax, etc. to provide the illumination device with a realistic candle look.

In this embodiment, the functional module 402 generally includes a flame-shaped fin 404, as part of pendulum 406 that is pivotally coupled to a housing 407 by a support member 408. The support member 408 is coupled to the housing 407 via grooves 441, and extends through an opening in the pendulum 406 (in similar fashion to the support member 308 in the illumination device 300). The pendulum 406 then rests in a groove portion of the support member 408, which generally holds the pendulum 406 against sliding along the support member 408. And, a driving device 412 is coupled (in a generally horizontal orientation) to a lower end portion of the pendulum 406 (via mount 435). The driving device 412 can then produce pivoting movement of the pendulum 406 (and the fin 404), via the support member 408 and relative to the housing 407. For example, the driving device 412 may again include a vibrating motor that vibrates intermittently when energized. The external force from the vibrating motor then causes the pendulum 406 and the fin 404 to pivotally move about the support member 408, relative to the housing 407, thereby creating a swinging flame effect. The housing 407 also includes half-portions that are coupled together by a sleeve 409 (e.g., to help with assembly of the device 400, etc.).

A lighting device 413 is located within the housing 407 to illuminate the fin 404 (e.g., as the fin 404 pivots, etc.). In particular, the lighting device 413 operates to project light onto a surface of the fin 404, which is then reflected from and/or transmitted through the fin 404 to generate a flame effect. The lighting device 413 generally includes an optical lens 415, a light source base 417, and a light source 418 (e.g., an LED light source, etc.). The light source 418 and the optical lens 415 are positioned, generally, at opposite end portions of the light source base 417. While the illustrated illumination device 400 includes a single lighting device 413, it should be appreciated that other embodiments of illumination devices may include multiple lighting devices each configured to project light onto surfaces of fins of the illumination devices.

The battery compartment 403 of the illumination device 400 includes a battery cartridge 425, batteries 401 positioned within the cartridge 425, a PCB 410, a power PCB 414, and a battery cover 428 coupled to the battery cartridge 425. A cover 455 is then provided generally over the components when the illumination device is assembled. The PCB 410 is electrically connected to the power PCB 414 by connecting wires. The PCB 410 is also electrically connected to the driving device 412 and the light source 418 by connecting wires. An upper portion of the battery cartridge 425 is provided with a positive elastic electrode 419 and a negative elastic electrode 420. The power PCB 414 is electrically connected to the batteries 401 by the positive and negative elastic electrodes 419 and 420. The PCB 410 also includes a PCB switch 432 (e.g., for activating and/or deactivating the illumination device 400, for other uses/operations, etc.) with a switch cover 422. And, the battery cover 428 includes a connecting plate 430 for connecting the batteries 401 in series.

FIGS. 18-22 illustrate another exemplary embodiment of an illumination device 500 including one or more aspects of the present disclosure. In this embodiment, the illumination device 500 is illustrated as an electric candle again. However, it should be appreciated that the illumination device 500 may be provided in other configurations, other than electric candles, in other embodiments.

The illumination device 500 of this embodiment generally includes a functional module 502 and a battery compartment 503. The functional module 502 and the battery compartment 503 are configured to couple to a shell 505. In addition, the functional module 502 generally includes a pendulum 506 pivotally coupled to a housing 507 by a support member 508 that extends through an opening of the pendulum 506. The pendulum 506 is supported by the support member 508 generally within the housing 507. And, end portions of the support member 508 couple to the housing 507 at fixing grooves 541 (FIG. 22) located along opposing sides of a central opening 544 of the housing 507. The support member 508 includes a generally bent shaft, and the pendulum 506 includes a step 539 (FIG. 22) configured to receive the support member 508, and a bracket 546 (e.g., formed as part of the pendulum 506, etc.). The pendulum 506 then rests in a low portion of the support member 508 (which allows pivoting movement of the pendulum 506 relative to the support member 508 but inhibits sliding movement of the pendulum 506 along the support member). And, a light source 518 and a flame-shaped head 504 are coupled to an upper portion of the pendulum 506. A collar 542 is then positioned generally around the opening 544 of the housing 507 (e.g., to conceal the inner components of the functional module 502, to provide a pleasing look to the functional module 502, etc.).

Also in this embodiment, a driving device 512 of the illumination device 500 generally includes a magnet 550 coupled to a lower portion 554 of the bracket 546, and an electromagnetic coil 552 disposed on a PCBA 510. With this construction, the bracket 546 is pivotally coupled to the housing via the pendulum 506. And in operation, when the PCBA 510 controls the power and current of the electromagnetic coil 552, a repulsive or attractive force is selectively produced between the magnet 550 and the electromagnetic coil 552. These produced forces cause the pendulum 506 to move, in turn moving the light source 518 and the head 504 relative to the housing 507. Because the PCBA 510 controls the repulsive and attractive forces of the driving device 512 (e.g., by controlling the current of the electromagnetic coil 552, etc.), it thereby controls the moving frequency/time of the pendulum 506, the light source 518, and the head 504.

Further in this embodiment, the light source 518 is connected to the PCBA 510 by conducting wires. In order to reduce the resistance of and/or interference with the pendulum 506 and the bracket 546, when moving, each of the conducting wires may be a lacquered wire with a very small diameter. In addition, another light source (e.g., an LED, etc.) 540 is positioned on the PCBA 510 within the housing 507. The PCBA 510 also controls operation of the light source 540. And, the light source 540 is configured to illuminate an upper portion of the device 500 through the housing 507.

And, again in this embodiment, the battery compartment 503 of the illumination device 500 includes a battery cartridge 525, batteries 501 positioned within the cartridge 525, and a battery cover 528 coupled to the battery cartridge 525. The PCBA 510 is electrically connected to the electrode of the battery cartridge 525 by connecting wires. The PCBA 510 is also electrically connected to a power switch 530 and a PCB switch 532 by a flat cable 536. During operation, the batteries 501 supply power to the PCBA 510, the electromagnetic coil 552, the light source 518, and the light source 540.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With that said, the foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An illumination device, comprising:

a housing;

a light source;

a pendulum supporting the light source, the pendulum pivotally coupled to the housing and configured to move the light source relative to the housing;

a control unit for providing power to the illumination device and for controlling operation of the light source; and at least one wire electrically connecting the light source to the control unit, the at least one wire having a diameter of about 0.5 millimeters or less to avoid impact to the pivotal movement of the pendulum.

2. The illumination device of claim 1, further comprising a support member coupled to the housing and the pendulum, the support member configured to allow pivotal movement of the pendulum and the light source relative to the housing; wherein the at least one wire is separate from the support member.

3. The illumination device of claim 2, further comprising a flame-shaped head, the light source disposed within the flame-shaped head.

4. The illumination device of claim 1, further comprising a flame-shaped head, the light source disposed within the flame-shaped head.

5. The illumination device of claim 4, further comprising a color element including a generally translucent, tube-shaped sleeve disposed within the flame-shaped head for creating a color effect when the light source transmits light through the color element.

6. An illumination device, comprising:

a housing;

a light source;

a color element including a generally translucent and tube-shaped sleeve; and a flame-shaped head, wherein the color element is disposed within the flame-shaped head;

wherein the light source is configured to illuminate an upper portion of the flame-shaped head with light from the light source independent of the color element and to illuminate a lower portion of the flame-shaped head with light from the light source passing through the color element.

7. The illumination device of claim 6, wherein the color element is generally blue.

8. An illumination device, comprising:

a housing;

a light source disposed above the housing;

a color element including a generally translucent and tube-shaped sleeve, wherein the color element is positioned over at least part of the light source such that the light source extends beyond a top end portion of the color element; and a flame-shaped head, wherein the light source and the color element are disposed within the flame-shaped head;

wherein the light source is configured to illuminate an upper portion of the flame-shaped head with light from the light source independent of the color element and to illuminate a lower portion of the flame-shaped head with light from the light source passing through the color element.

9. The illumination device of claim 8, wherein the light source defines a generally cylindrical shape.

* * * * *